US009068428B2

(12) United States Patent
Mazyar et al.

(10) Patent No.: US 9,068,428 B2
(45) Date of Patent: Jun. 30, 2015

(54) SELECTIVELY CORRODIBLE DOWNHOLE ARTICLE AND METHOD OF USE

(75) Inventors: Oleg A. Mazyar, Houston, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 484 days.

(21) Appl. No.: 13/371,788

(22) Filed: Feb. 13, 2012

(65) Prior Publication Data

US 2013/0206425 A1 Aug. 15, 2013

(51) Int. Cl.

| | |
|---|---|
| ***E21B 34/06*** | (2006.01) |
| ***E21B 33/12*** | (2006.01) |
| ***E21B 43/285*** | (2006.01) |
| ***E21B 43/28*** | (2006.01) |
| *E21B 34/00* | (2006.01) |

(52) U.S. Cl.

CPC ..... *E21B 33/12* (2013.01); *E21B 2034/002* (2013.01); *E21B 34/063* (2013.01); *E21B 43/285* (2013.01); *E21B 43/28* (2013.01); *E21B 34/06* (2013.01)

(58) Field of Classification Search

CPC ..... E21B 34/06; E21B 33/12; E21B 34/063; E21B 43/28; E21B 43/285; E21B 2034/002

USPC ..... 166/376, 192, 193, 317, 250.05

See application file for complete search history.

(56) References Cited

U.S. PATENT DOCUMENTS

| | | | |
|---|---|---|---|
| 1,468,905 | A | 9/1923 | Herman |
| 2,238,895 | A | 4/1941 | Gage |
| 2,261,292 | A | 11/1941 | Salnikov |
| 2,294,648 | A | 9/1942 | Ansel et al. |
| 2,301,624 | A | 11/1942 | Holt |

(Continued)

FOREIGN PATENT DOCUMENTS

| | | | |
|---|---|---|---|
| CN | 1076968 | A | 10/1993 |
| CN | 1255879 | A | 6/2000 |

(Continued)

OTHER PUBLICATIONS

International Search Report and Written Opinion for International application No. PCT/US2012/034973 filed on Apr. 25, 2012, mailed on Nov. 29, 2012.

(Continued)

*Primary Examiner* — Yong-Suk (Philip) Ro
(74) *Attorney, Agent, or Firm* — Cantor Colburn LLP

(57) ABSTRACT

A selectively corrodible downhole article includes a movable cylindrical member comprising a first section and an axially separated second section, the first section comprising a first material having a first galvanic activity, the second section comprising a second material having a second galvanic activity, the first galvanic activity greater than the second, the first section electrically isolated from the second section. The article also includes a fixed member disposed on the cylindrical member and configured for electrical contact with the first or second section, the fixed member comprising an intermediate material having an intermediate galvanic activity, the intermediate galvanic activity intermediate the first and second galvanic activity, the movable cylindrical member configured for movement from a first position where the first section is disposed and in electrical contact with the fixed member and a second position where the second section is disposed and in electrical contact with the fixed member.

23 Claims, 5 Drawing Sheets

(56) References Cited

U.S. PATENT DOCUMENTS

| | | | |
|---|---|---|---|
| 2,754,910 | A | 7/1956 | Derrick et al. |
| 2,983,634 | A | 5/1961 | Budininkas et al. |
| 3,057,405 | A | 10/1962 | Mallinger |
| 3,106,959 | A | 10/1963 | Huitt et al. |
| 3,152,009 | A | 10/1964 | DeLong |
| 3,196,949 | A | 7/1965 | Thomas |
| 3,242,988 | A | 3/1966 | McGuire et al. |
| 3,316,748 | A | 5/1967 | Lang et al. |
| 3,326,291 | A | 6/1967 | Zandmer et al. |
| 3,347,317 | A | 10/1967 | Myron |
| 3,347,714 | A | 10/1967 | Broverman et al. |
| 3,390,724 | A | 7/1968 | Caldwell |
| 3,395,758 | A | 8/1968 | Kelly et al. |
| 3,406,101 | A | 10/1968 | Kilpatrick |
| 3,343,537 | A | 3/1969 | Zandmer |
| 3,465,181 | A | 9/1969 | Colby et al. |
| 3,513,230 | A | 5/1970 | Rhees et al. |
| 3,637,446 | A | 1/1972 | Elliott et al. |
| 3,645,331 | A | 2/1972 | Maurer et al. |
| 3,765,484 | A | 10/1973 | Hamby, Jr. et al. |
| 3,768,563 | A | 10/1973 | Blount |
| 3,775,823 | A | 12/1973 | Adolph et al. |
| 3,878,889 | A | 4/1975 | Seabourn |
| 3,894,850 | A | 7/1975 | Kovalchuk et al. |
| 3,924,677 | A | 12/1975 | Prenner et al. |
| 4,010,583 | A | 3/1977 | Highberg |
| 4,039,717 | A | 8/1977 | Titus |
| 4,050,529 | A | 9/1977 | Tagirov et al. |
| 4,157,732 | A | 6/1979 | Fonner |
| 4,248,307 | A | 2/1981 | Silberman et al. |
| 4,372,384 | A | 2/1983 | Kinney |
| 4,373,584 | A | 2/1983 | Silberman et al. |
| 4,373,952 | A | 2/1983 | Parent |
| 4,374,543 | A | 2/1983 | Richardson |
| 4,384,616 | A | 5/1983 | Dellinger |
| 4,395,440 | A | 7/1983 | Abe et al. |
| 4,399,871 | A | 8/1983 | Adkins et al. |
| 4,407,368 | A | 10/1983 | Erbstoesser |
| 4,422,508 | A | 12/1983 | Rutledge, Jr. et al. |
| 4,452,311 | A | 6/1984 | Speegle et al. |
| 4,475,729 | A | 10/1984 | Costigan |
| 4,498,543 | A | 2/1985 | Pye et al. |
| 4,499,048 | A | 2/1985 | Hanejko |
| 4,499,049 | A | 2/1985 | Hanejko |
| 4,526,840 | A | 7/1985 | Jerabek |
| 4,534,414 | A | 8/1985 | Pringle |
| 4,539,175 | A | 9/1985 | Lichti et al. |
| 4,554,986 | A | 11/1985 | Jones |
| 4,640,354 | A | 2/1987 | Boisson |
| 4,664,962 | A | 5/1987 | DesMarais, Jr. |
| 4,668,470 | A | 5/1987 | Gilman et al. |
| 4,673,549 | A | 6/1987 | Ecer |
| 4,674,572 | A | 6/1987 | Gallus |
| 4,678,037 | A | 7/1987 | Smith |
| 4,681,133 | A | 7/1987 | Weston |
| 4,688,641 | A | 8/1987 | Knieriemen |
| 4,693,863 | A | 9/1987 | Del Corso et al. |
| 4,703,807 | A | 11/1987 | Weston |
| 4,706,753 | A | 11/1987 | Ohkochi et al. |
| 4,708,202 | A | 11/1987 | Sukup et al. |
| 4,708,208 | A | 11/1987 | Halbardier |
| 4,709,761 | A | 12/1987 | Setterberg, Jr. |
| 4,714,116 | A | 12/1987 | Brunner |
| 4,716,964 | A | 1/1988 | Erbstoesser et al. |
| 4,721,159 | A | 1/1988 | Ohkochi et al. |
| 4,738,599 | A | 4/1988 | Shilling |
| 4,741,973 | A | 5/1988 | Condit et al. |
| 4,768,588 | A | 9/1988 | Kupsa |
| 4,775,598 | A | 10/1988 | Jaeckel |
| 4,784,226 | A | 11/1988 | Wyatt |
| 4,805,699 | A | 2/1989 | Halbardier |
| 4,817,725 | A | 4/1989 | Jenkins |
| 4,834,184 | A | 5/1989 | Streich et al. |
| H635 | H | 6/1989 | Johnson et al. |
| 4,850,432 | A | 7/1989 | Porter et al. |
| 4,853,056 | A | 8/1989 | Hoffman |
| 4,869,324 | A | 9/1989 | Holder |
| 4,869,325 | A | 9/1989 | Halbardier |
| 4,889,187 | A | 12/1989 | Terrell et al. |
| 4,890,675 | A | 1/1990 | Dew |
| 4,909,320 | A | 3/1990 | Hebert et al. |
| 4,929,415 | A | 5/1990 | Okazaki |
| 4,932,474 | A | 6/1990 | Schroeder, Jr. et al. |
| 4,938,309 | A | 7/1990 | Emdy |
| 4,938,809 | A | 7/1990 | Das et al. |
| 4,944,351 | A | 7/1990 | Eriksen et al. |
| 4,949,788 | A | 8/1990 | Szarka et al. |
| 4,952,902 | A | 8/1990 | Kawaguchi et al. |
| 4,975,412 | A | 12/1990 | Okazaki et al. |
| 4,977,958 | A | 12/1990 | Miller |
| 4,981,177 | A | 1/1991 | Carmody et al. |
| 4,986,361 | A | 1/1991 | Mueller et al. |
| 4,997,622 | A | 3/1991 | Regazzoni et al. |
| 5,006,044 | A | 4/1991 | Walker, Sr. et al. |
| 5,010,955 | A | 4/1991 | Springer |
| 5,036,921 | A | 8/1991 | Pittard et al. |
| 5,048,611 | A | 9/1991 | Cochran |
| 5,049,165 | A | 9/1991 | Tselesin |
| 5,061,323 | A | 10/1991 | DeLuccia |
| 5,063,775 | A | 11/1991 | Walker, Sr. et al. |
| 5,073,207 | A | 12/1991 | Faure et al. |
| 5,074,361 | A | 12/1991 | Brisco et al. |
| 5,076,869 | A | 12/1991 | Bourell et al. |
| 5,084,088 | A | 1/1992 | Okazaki |
| 5,087,304 | A | 2/1992 | Chang et al. |
| 5,090,480 | A | 2/1992 | Pittard et al. |
| 5,095,988 | A | 3/1992 | Bode |
| 5,103,911 | A | 4/1992 | Heijnen |
| 5,117,915 | A | 6/1992 | Mueller et al. |
| 5,161,614 | A | 11/1992 | Wu et al. |
| 5,178,216 | A | 1/1993 | Giroux et al. |
| 5,181,571 | A | 1/1993 | Mueller et al. |
| 5,183,631 | A | 2/1993 | Kugimiya et al. |
| 5,188,182 | A | 2/1993 | Echols, III et al. |
| 5,188,183 | A | 2/1993 | Hopmann et al. |
| 5,204,055 | A | 4/1993 | Sachs et al. |
| 5,222,867 | A | 6/1993 | Walker, Sr. et al. |
| 5,226,483 | A | 7/1993 | Williamson, Jr. |
| 5,228,518 | A | 7/1993 | Wilson et al. |
| 5,234,055 | A | 8/1993 | Cornette |
| 5,252,365 | A | 10/1993 | White |
| 5,253,714 | A | 10/1993 | Davis et al. |
| 5,271,468 | A | 12/1993 | Streich et al. |
| 5,282,509 | A | 2/1994 | Schurr, III |
| 5,292,478 | A | 3/1994 | Scorey |
| 5,293,940 | A | 3/1994 | Hromas et al. |
| 5,304,260 | A | 4/1994 | Aikawa et al. |
| 5,309,874 | A | 5/1994 | Willermet et al. |
| 5,310,000 | A | 5/1994 | Arterbury et al. |
| 5,316,598 | A | 5/1994 | Chang et al. |
| 5,318,746 | A | 6/1994 | Lashmore |
| 5,380,473 | A | 1/1995 | Bogue et al. |
| 5,387,380 | A | 2/1995 | Cima et al. |
| 5,392,860 | A | 2/1995 | Ross |
| 5,394,941 | A | 3/1995 | Venditto et al. |
| 5,398,754 | A | 3/1995 | Dinhoble |
| 5,407,011 | A | 4/1995 | Layton |
| 5,409,555 | A | 4/1995 | Fujita et al. |
| 5,411,082 | A | 5/1995 | Kennedy |
| 5,417,285 | A | 5/1995 | Van Buskirk et al. |
| 5,425,424 | A | 6/1995 | Reinhardt et al. |
| 5,427,177 | A | 6/1995 | Jordan, Jr. et al. |
| 5,435,392 | A | 7/1995 | Kennedy |
| 5,439,051 | A | 8/1995 | Kennedy et al. |
| 5,454,430 | A | 10/1995 | Kennedy et al. |
| 5,456,317 | A | 10/1995 | Hood, III et al. |
| 5,456,327 | A | 10/1995 | Denton et al. |
| 5,464,062 | A | 11/1995 | Blizzard, Jr. |
| 5,472,048 | A | 12/1995 | Kennedy et al. |
| 5,474,131 | A | 12/1995 | Jordan, Jr. et al. |
| 5,477,923 | A | 12/1995 | Jordan, Jr. et al. |
| 5,479,986 | A | 1/1996 | Gano et al. |
| 5,507,439 | A | 4/1996 | Story |
| 5,526,880 | A | 6/1996 | Jordan, Jr. et al. |

(56) References Cited

U.S. PATENT DOCUMENTS

| | | | |
|---|---|---|---|
| 5,526,881 | A | 6/1996 | Martin et al. |
| 5,529,746 | A | 6/1996 | Knoss et al. |
| 5,533,573 | A | 7/1996 | Jordan, Jr. et al. |
| 5,536,485 | A | 7/1996 | Kume et al. |
| 5,558,153 | A | 9/1996 | Holcombe et al. |
| 5,607,017 | A | 3/1997 | Owens et al. |
| 5,623,993 | A | 4/1997 | Van Buskirk et al. |
| 5,623,994 | A | 4/1997 | Robinson |
| 5,636,691 | A | 6/1997 | Hendrickson et al. |
| 5,641,023 | A | 6/1997 | Ross et al. |
| 5,647,444 | A | 7/1997 | Williams |
| 5,665,289 | A | 9/1997 | Chung et al. |
| 5,677,372 | A | 10/1997 | Yamamoto et al. |
| 5,685,372 | A | 11/1997 | Gano |
| 5,701,576 | A | 12/1997 | Fujita et al. |
| 5,707,214 | A | 1/1998 | Schmidt |
| 5,709,269 | A | 1/1998 | Head |
| 5,720,344 | A | 2/1998 | Newman |
| 5,728,195 | A | 3/1998 | Eastman et al. |
| 5,765,639 | A | 6/1998 | Muth |
| 5,772,735 | A | 6/1998 | Sehgal et al. |
| 5,782,305 | A | 7/1998 | Hicks |
| 5,797,454 | A | 8/1998 | Hipp |
| 5,826,652 | A | 10/1998 | Tapp |
| 5,826,661 | A | 10/1998 | Parker et al. |
| 5,829,520 | A | 11/1998 | Johnson |
| 5,836,396 | A | 11/1998 | Norman |
| 5,857,521 | A | 1/1999 | Ross et al. |
| 5,881,816 | A | 3/1999 | Wright |
| 5,896,819 | A | 4/1999 | Turila et al. |
| 5,902,424 | A | 5/1999 | Fujita et al. |
| 5,934,372 | A | 8/1999 | Muth |
| 5,941,309 | A | 8/1999 | Appleton |
| 5,960,881 | A | 10/1999 | Allamon et al. |
| 5,985,466 | A | 11/1999 | Atarashi et al. |
| 5,990,051 | A | 11/1999 | Ischy et al. |
| 5,992,452 | A | 11/1999 | Nelson, II |
| 5,992,520 | A | 11/1999 | Schultz et al. |
| 6,007,314 | A | 12/1999 | Nelson, II |
| 6,024,915 | A | 2/2000 | Kume et al. |
| 6,032,735 | A | 3/2000 | Echols |
| 6,036,777 | A | 3/2000 | Sachs |
| 6,047,773 | A | 4/2000 | Zeltmann et al. |
| 6,050,340 | A | 4/2000 | Scott |
| 6,069,313 | A | 5/2000 | Kay |
| 6,076,600 | A | 6/2000 | Vick, Jr. et al. |
| 6,079,496 | A | 6/2000 | Hirth |
| 6,085,837 | A | 7/2000 | Massinon et al. |
| 6,095,247 | A | 8/2000 | Streich et al. |
| 6,119,783 | A | 9/2000 | Parker et al. |
| 6,142,237 | A | 11/2000 | Christmas et al. |
| 6,161,622 | A | 12/2000 | Robb et al. |
| 6,167,970 | B1 | 1/2001 | Stout et al. |
| 6,170,583 | B1 | 1/2001 | Boyce |
| 6,173,779 | B1 | 1/2001 | Smith |
| 6,189,616 | B1 | 2/2001 | Gano et al. |
| 6,189,618 | B1 | 2/2001 | Beeman et al. |
| 6,213,202 | B1 | 4/2001 | Read, Jr. |
| 6,220,350 | B1 | 4/2001 | Brothers et al. |
| 6,220,357 | B1 | 4/2001 | Carmichael |
| 6,228,904 | B1 | 5/2001 | Yadav et al. |
| 6,237,688 | B1 | 5/2001 | Burleson et al. |
| 6,238,280 | B1 | 5/2001 | Ritt et al. |
| 6,241,021 | B1 | 6/2001 | Bowling |
| 6,248,399 | B1 | 6/2001 | Hehmann |
| 6,250,392 | B1 | 6/2001 | Muth |
| 6,261,432 | B1 | 7/2001 | Huber et al. |
| 6,273,187 | B1 | 8/2001 | Voisin, Jr. et al. |
| 6,276,452 | B1 | 8/2001 | Davis et al. |
| 6,276,457 | B1 | 8/2001 | Moffatt et al. |
| 6,279,656 | B1 | 8/2001 | Sinclair et al. |
| 6,287,445 | B1 | 9/2001 | Lashmore et al. |
| 6,302,205 | B1 | 10/2001 | Ryll |
| 6,315,041 | B1 | 11/2001 | Carlisle et al. |
| 6,315,050 | B2 | 11/2001 | Vaynshteyn et al. |
| 6,325,148 | B1 | 12/2001 | Trahan et al. |
| 6,328,110 | B1 | 12/2001 | Joubert |
| 6,341,653 | B1 | 1/2002 | Firmaniuk et al. |
| 6,341,747 | B1 | 1/2002 | Schmidt et al. |
| 6,349,766 | B1 | 2/2002 | Bussear et al. |
| 6,354,379 | B2 | 3/2002 | Miszewski et al. |
| 6,357,322 | B1 | 3/2002 | Vecchio |
| 6,357,332 | B1 | 3/2002 | Vecchio |
| 6,371,206 | B1 | 4/2002 | Mills |
| 6,372,346 | B1 | 4/2002 | Toth |
| 6,382,244 | B2 | 5/2002 | Vann |
| 6,390,195 | B1 | 5/2002 | Nguyen et al. |
| 6,390,200 | B1 | 5/2002 | Allamon et al. |
| 6,394,185 | B1 | 5/2002 | Constien |
| 6,397,950 | B1 | 6/2002 | Streich et al. |
| 6,403,210 | B1 | 6/2002 | Stuivinga et al. |
| 6,408,946 | B1 | 6/2002 | Marshall et al. |
| 6,419,023 | B1 | 7/2002 | George et al. |
| 6,439,313 | B1 | 8/2002 | Thomeer et al. |
| 6,457,525 | B1 | 10/2002 | Scott |
| 6,467,546 | B2 | 10/2002 | Allamon et al. |
| 6,470,965 | B1 | 10/2002 | Winzer |
| 6,491,097 | B1 | 12/2002 | ONeal et al. |
| 6,491,116 | B2 | 12/2002 | Berscheidt et al. |
| 6,513,598 | B2 | 2/2003 | Moore et al. |
| 6,540,033 | B1 | 4/2003 | Sullivan et al. |
| 6,543,543 | B2 | 4/2003 | Muth |
| 6,561,275 | B2 | 5/2003 | Glass et al. |
| 6,588,507 | B2 | 7/2003 | Dusterhoft et al. |
| 6,591,915 | B2 | 7/2003 | Burris et al. |
| 6,601,648 | B2 | 8/2003 | Ebinger |
| 6,601,650 | B2 | 8/2003 | Sundararajan |
| 6,609,569 | B2 | 8/2003 | Howlett et al. |
| 6,612,826 | B1 | 9/2003 | Bauer et al. |
| 6,613,383 | B1 | 9/2003 | George et al. |
| 6,619,400 | B2 | 9/2003 | Brunet |
| 6,634,428 | B2 | 10/2003 | Krauss et al. |
| 6,662,886 | B2 | 12/2003 | Russell |
| 6,675,889 | B1 | 1/2004 | Mullins et al. |
| 6,699,305 | B2 | 3/2004 | Myrick |
| 6,713,177 | B2 | 3/2004 | George et al. |
| 6,715,541 | B2 | 4/2004 | Pedersen et al. |
| 6,719,051 | B2 | 4/2004 | Hailey, Jr. et al. |
| 6,755,249 | B2 | 6/2004 | Robison et al. |
| 6,776,228 | B2 | 8/2004 | Pedersen et al. |
| 6,779,599 | B2 | 8/2004 | Mullins et al. |
| 6,799,638 | B2 | 10/2004 | Butterfield, Jr. |
| 6,810,960 | B2 | 11/2004 | Pia |
| 6,817,414 | B2 | 11/2004 | Lee |
| 6,831,044 | B2 | 12/2004 | Constien |
| 6,883,611 | B2 | 4/2005 | Smith et al. |
| 6,887,297 | B2 | 5/2005 | Winter et al. |
| 6,896,049 | B2 | 5/2005 | Moyes |
| 6,896,061 | B2 | 5/2005 | Hriscu et al. |
| 6,899,176 | B2 | 5/2005 | Hailey, Jr. et al. |
| 6,899,777 | B2 | 5/2005 | Vaidyanathan et al. |
| 6,908,516 | B2 | 6/2005 | Hehmann et al. |
| 6,913,827 | B2 | 7/2005 | George et al. |
| 6,926,086 | B2 | 8/2005 | Patterson et al. |
| 6,932,159 | B2 | 8/2005 | Hovem |
| 6,939,388 | B2 | 9/2005 | Angeliu |
| 6,945,331 | B2 | 9/2005 | Patel |
| 6,959,759 | B2 | 11/2005 | Doane et al. |
| 6,973,970 | B2 | 12/2005 | Johnston et al. |
| 6,973,973 | B2 | 12/2005 | Howard et al. |
| 6,983,796 | B2 | 1/2006 | Bayne et al. |
| 6,986,390 | B2 | 1/2006 | Doane et al. |
| 7,013,989 | B2 | 3/2006 | Hammond et al. |
| 7,013,998 | B2 | 3/2006 | Ray et al. |
| 7,017,664 | B2 | 3/2006 | Walker et al. |
| 7,017,677 | B2 | 3/2006 | Keshavan et al. |
| 7,021,389 | B2 | 4/2006 | Bishop et al. |
| 7,025,146 | B2 | 4/2006 | King et al. |
| 7,028,778 | B2 | 4/2006 | Krywitsky |
| 7,044,230 | B2 | 5/2006 | Starr et al. |
| 7,049,272 | B2 | 5/2006 | Sinclair et al. |
| 7,051,805 | B2 | 5/2006 | Doane et al. |
| 7,059,410 | B2 | 6/2006 | Bousche et al. |
| 7,090,027 | B1 | 8/2006 | Williams |

(56) References Cited

U.S. PATENT DOCUMENTS

| | | | |
|---|---|---|---|
| 7,093,664 | B2 | 8/2006 | Todd et al. |
| 7,096,945 | B2 | 8/2006 | Richards et al. |
| 7,096,946 | B2 | 8/2006 | Jasser et al. |
| 7,097,906 | B2 | 8/2006 | Gardner |
| 7,108,080 | B2 | 9/2006 | Tessari et al. |
| 7,111,682 | B2 | 9/2006 | Blaisdell |
| 7,141,207 | B2 | 11/2006 | Jandeska, Jr. et al. |
| 7,150,326 | B2 | 12/2006 | Bishop et al. |
| 7,163,066 | B2 | 1/2007 | Lehr |
| 7,168,494 | B2 | 1/2007 | Starr et al. |
| 7,174,963 | B2 | 2/2007 | Bertelsen |
| 7,182,135 | B2 | 2/2007 | Szarka |
| 7,188,559 | B1 | 3/2007 | Vecchio |
| 7,210,527 | B2 | 5/2007 | Walker et al. |
| 7,210,533 | B2 | 5/2007 | Starr et al. |
| 7,217,311 | B2 | 5/2007 | Hong et al. |
| 7,234,530 | B2 | 6/2007 | Gass |
| 7,250,188 | B2 | 7/2007 | Dodelet et al. |
| 7,252,162 | B2 | 8/2007 | Akinlade et al. |
| 7,255,172 | B2 | 8/2007 | Johnson |
| 7,255,178 | B2 | 8/2007 | Slup et al. |
| 7,264,060 | B2 | 9/2007 | Wills |
| 7,267,172 | B2 | 9/2007 | Hofman |
| 7,267,178 | B2 | 9/2007 | Krywitsky |
| 7,270,186 | B2 | 9/2007 | Johnson |
| 7,287,592 | B2 | 10/2007 | Surjaatmadja et al. |
| 7,311,152 | B2 | 12/2007 | Howard et al. |
| 7,320,365 | B2 | 1/2008 | Pia |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,384,443 | B2 | 6/2008 | Mirchandani |
| 7,387,158 | B2 | 6/2008 | Murray et al. |
| 7,387,165 | B2 | 6/2008 | Lopez de Cardenas et al. |
| 7,392,841 | B2 | 7/2008 | Murray et al. |
| 7,401,648 | B2 | 7/2008 | Richard |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,503,390 | B2 | 3/2009 | Gomez |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,527,103 | B2 | 5/2009 | Huang et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,635,023 | B2 | 12/2009 | Goldberg et al. |
| 7,640,988 | B2 | 1/2010 | Phi et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,703,510 | B2 | 4/2010 | Xu |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Barnett |
| 7,775,284 | B2 | 8/2010 | Richards et al. |
| 7,775,286 | B2 | 8/2010 | Duphorne |
| 7,784,543 | B2 | 8/2010 | Johnson |
| 7,793,714 | B2 | 9/2010 | Johnson |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,855,168 | B2 | 12/2010 | Fuller et al. |
| 7,861,779 | B2 | 1/2011 | Vestavik |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clark et al. |
| 7,909,104 | B2 | 3/2011 | Bjorgum |
| 7,909,110 | B2 | 3/2011 | Sharma et al. |
| 7,909,115 | B2 | 3/2011 | Grove et al. |
| 7,913,765 | B2 | 3/2011 | Crow et al. |
| 7,931,093 | B2 | 4/2011 | Foster et al. |
| 7,938,191 | B2 | 5/2011 | Vaidya |
| 7,946,335 | B2 | 5/2011 | Bewlay et al. |
| 7,946,340 | B2 | 5/2011 | Surjaatmadja et al. |
| 7,958,940 | B2 | 6/2011 | Jameson |
| 7,963,331 | B2 | 6/2011 | Surjaatmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 7,992,763 | B2 | 8/2011 | Vecchio et al. |
| 8,020,619 | B1 | 9/2011 | Robertson et al. |
| 8,020,620 | B2 | 9/2011 | Daniels et al. |
| 8,025,104 | B2 | 9/2011 | Cooke, Jr. |
| 8,028,767 | B2 | 10/2011 | Radford et al. |
| 8,033,331 | B2 | 10/2011 | Themig |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 8,109,340 | B2 | 2/2012 | Doane et al. |
| 8,127,856 | B1 | 3/2012 | Nish et al. |
| 8,153,052 | B2 | 4/2012 | Jackson et al. |
| 8,163,060 | B2 | 4/2012 | Imanishi et al. |
| 8,211,247 | B2 | 7/2012 | Marya et al. |
| 8,211,248 | B2 | 7/2012 | Marya |
| 8,226,740 | B2 | 7/2012 | Chaumonnot et al. |
| 8,230,731 | B2 | 7/2012 | Dyer et al. |
| 8,231,947 | B2 | 7/2012 | Vaidya et al. |
| 8,276,670 | B2 | 10/2012 | Patel |
| 8,277,974 | B2 | 10/2012 | Kumar et al. |
| 8,297,364 | B2 | 10/2012 | Agrawal et al. |
| 8,327,931 | B2 | 12/2012 | Agrawal et al. |
| 8,403,037 | B2 | 3/2013 | Agrawal et al. |

(56) References Cited

U.S. PATENT DOCUMENTS

| | | | |
|---|---|---|---|
| 8,425,651 | B2 | 4/2013 | Xu et al. |
| 2001/0045285 | A1 | 11/2001 | Russell |
| 2001/0045288 | A1 | 11/2001 | Allamon et al. |
| 2002/0000319 | A1 | 1/2002 | Brunet |
| 2002/0007948 | A1 | 1/2002 | Bayne et al. |
| 2002/0014268 | A1 | 2/2002 | Vann |
| 2002/0066572 | A1 | 6/2002 | Muth |
| 2002/0104616 | A1 | 8/2002 | De et al. |
| 2002/0136904 | A1 | 9/2002 | Glass et al. |
| 2002/0162661 | A1 | 11/2002 | Krauss et al. |
| 2003/0037925 | A1 | 2/2003 | Walker et al. |
| 2003/0060374 | A1 | 3/2003 | Cooke, Jr. |
| 2003/0075326 | A1 | 4/2003 | Ebinger |
| 2003/0104147 | A1 | 6/2003 | Bretschneider et al. |
| 2003/0111728 | A1 | 6/2003 | Thai et al. |
| 2003/0127013 | A1 | 7/2003 | Zavitsanos et al. |
| 2003/0141060 | A1 | 7/2003 | Hailey et al. |
| 2003/0141061 | A1 | 7/2003 | Hailey et al. |
| 2003/0141079 | A1 | 7/2003 | Doane et al. |
| 2003/0150614 | A1 | 8/2003 | Brown et al. |
| 2003/0155114 | A1 | 8/2003 | Pedersen et al. |
| 2003/0155115 | A1 | 8/2003 | Pedersen et al. |
| 2003/0159828 | A1 | 8/2003 | Howard et al. |
| 2003/0164237 | A1 | 9/2003 | Butterfield |
| 2003/0183391 | A1 | 10/2003 | Hriscu et al. |
| 2004/0005483 | A1 | 1/2004 | Lin |
| 2004/0020832 | A1 | 2/2004 | Richards et al. |
| 2004/0031605 | A1 | 2/2004 | Mickey |
| 2004/0045723 | A1 | 3/2004 | Slup et al. |
| 2004/0055758 | A1 | 3/2004 | Brezinski et al. |
| 2004/0089449 | A1 | 5/2004 | Walton et al. |
| 2004/0154806 | A1 | 8/2004 | Bode et al. |
| 2004/0159428 | A1 | 8/2004 | Hammond et al. |
| 2004/0182583 | A1 | 9/2004 | Doane et al. |
| 2004/0231845 | A1 | 11/2004 | Cooke |
| 2004/0256109 | A1 | 12/2004 | Johnson |
| 2004/0256157 | A1 | 12/2004 | Tessari et al. |
| 2004/0261993 | A1 | 12/2004 | Nguyen |
| 2005/0034876 | A1 | 2/2005 | Doane et al. |
| 2005/0051329 | A1 | 3/2005 | Blaisdell |
| 2005/0064247 | A1 | 3/2005 | Sane et al. |
| 2005/0069449 | A1 | 3/2005 | Jackson et al. |
| 2005/0102255 | A1 | 5/2005 | Bultman |
| 2005/0106316 | A1 | 5/2005 | Rigney et al. |
| 2005/0161212 | A1 | 7/2005 | Leismer et al. |
| 2005/0161224 | A1 | 7/2005 | Starr et al. |
| 2005/0165149 | A1 | 7/2005 | Chanak et al. |
| 2005/0194143 | A1 | 9/2005 | Xu et al. |
| 2005/0199401 | A1 | 9/2005 | Patel et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2005/0241824 | A1 | 11/2005 | Burris, II et al. |
| 2005/0241825 | A1 | 11/2005 | Burris, II et al. |
| 2005/0257936 | A1 | 11/2005 | Lehr |
| 2005/0279501 | A1 | 12/2005 | Surjaatmadja et al. |
| 2006/0012087 | A1 | 1/2006 | Matsuda et al. |
| 2006/0045787 | A1 | 3/2006 | Jandeska et al. |
| 2006/0057479 | A1 | 3/2006 | Niimi et al. |
| 2006/0081378 | A1 | 4/2006 | Howard et al. |
| 2006/0102871 | A1 | 5/2006 | Wang et al. |
| 2006/0108114 | A1 | 5/2006 | Johnson et al. |
| 2006/0108126 | A1 | 5/2006 | Horn et al. |
| 2006/0110615 | A1 | 5/2006 | Karim et al. |
| 2006/0116696 | A1 | 6/2006 | Odermatt et al. |
| 2006/0124310 | A1 | 6/2006 | Lopez de Cardenas et al. |
| 2006/0124312 | A1 | 6/2006 | Rytlewski et al. |
| 2006/0131011 | A1 | 6/2006 | Lynde et al. |
| 2006/0131031 | A1 | 6/2006 | McKeachnie et al. |
| 2006/0131081 | A1 | 6/2006 | Mirchandaniet et al. |
| 2006/0144515 | A1 | 7/2006 | Tada et al. |
| 2006/0150770 | A1 | 7/2006 | Freim, III et al. |
| 2006/0151178 | A1 | 7/2006 | Howard et al. |
| 2006/0162927 | A1 | 7/2006 | Walker et al. |
| 2006/0169453 | A1 | 8/2006 | Savery et al. |
| 2006/0213670 | A1 | 9/2006 | Bishop et al. |
| 2006/0231253 | A1 | 10/2006 | Vilela et al. |
| 2006/0283592 | A1 | 12/2006 | Sierra et al. |
| 2007/0017674 | A1 | 1/2007 | Blaisdell |
| 2007/0017675 | A1 | 1/2007 | Hammami et al. |
| 2007/0029082 | A1 | 2/2007 | Giroux et al. |
| 2007/0039741 | A1 | 2/2007 | Hailey |
| 2007/0044958 | A1 | 3/2007 | Rytlewski et al. |
| 2007/0044966 | A1 | 3/2007 | Davies et al. |
| 2007/0051521 | A1 | 3/2007 | Fike et al. |
| 2007/0053785 | A1 | 3/2007 | Hetz et al. |
| 2007/0054101 | A1 | 3/2007 | Sigalas et al. |
| 2007/0057415 | A1 | 3/2007 | Katagiri et al. |
| 2007/0062644 | A1 | 3/2007 | Nakamura et al. |
| 2007/0074873 | A1 | 4/2007 | McKeachnie et al. |
| 2007/0102199 | A1 | 5/2007 | Smith et al. |
| 2007/0107899 | A1 | 5/2007 | Werner et al. |
| 2007/0107908 | A1 | 5/2007 | Vaidya et al. |
| 2007/0108060 | A1 | 5/2007 | Park |
| 2007/0119600 | A1 | 5/2007 | Slup et al. |
| 2007/0131912 | A1 | 6/2007 | Simone et al. |
| 2007/0151009 | A1 | 7/2007 | Conrad, III et al. |
| 2007/0151769 | A1 | 7/2007 | Slutz et al. |
| 2007/0169935 | A1 | 7/2007 | Akbar et al. |
| 2007/0181224 | A1 | 8/2007 | Marya et al. |
| 2007/0185655 | A1 | 8/2007 | Le Bemadjiel |
| 2007/0187095 | A1 | 8/2007 | Walker et al. |
| 2007/0221373 | A1 | 9/2007 | Murray |
| 2007/0221384 | A1 | 9/2007 | Murray |
| 2007/0259994 | A1 | 11/2007 | Tour et al. |
| 2007/0261862 | A1 | 11/2007 | Murray |
| 2007/0272411 | A1 | 11/2007 | Lopez De Cardenas et al. |
| 2007/0272413 | A1 | 11/2007 | Rytlewski et al. |
| 2007/0277979 | A1 | 12/2007 | Todd et al. |
| 2007/0284109 | A1 | 12/2007 | East et al. |
| 2007/0284112 | A1 | 12/2007 | Magne et al. |
| 2007/0299510 | A1 | 12/2007 | Venkatraman et al. |
| 2008/0011473 | A1 | 1/2008 | Wood et al. |
| 2008/0020923 | A1 | 1/2008 | Debe et al. |
| 2008/0047707 | A1 | 2/2008 | Boney et al. |
| 2008/0060810 | A9 | 3/2008 | Nguyen et al. |
| 2008/0066923 | A1 | 3/2008 | Xu |
| 2008/0066924 | A1 | 3/2008 | Xu |
| 2008/0078553 | A1 | 4/2008 | George |
| 2008/0081866 | A1 | 4/2008 | Gong et al. |
| 2008/0099209 | A1 | 5/2008 | Loretz et al. |
| 2008/0105438 | A1 | 5/2008 | Jordan et al. |
| 2008/0115932 | A1 | 5/2008 | Cooke |
| 2008/0121390 | A1 | 5/2008 | O'Malley et al. |
| 2008/0121436 | A1 | 5/2008 | Slay et al. |
| 2008/0127475 | A1 | 6/2008 | Griffo |
| 2008/0149325 | A1 | 6/2008 | Crawford |
| 2008/0149345 | A1 | 6/2008 | Marya et al. |
| 2008/0149351 | A1 | 6/2008 | Marya et al. |
| 2008/0169105 | A1 | 7/2008 | Williamson et al. |
| 2008/0179104 | A1 | 7/2008 | Zhang et al. |
| 2008/0202764 | A1 | 8/2008 | Clayton et al. |
| 2008/0202814 | A1 | 8/2008 | Lyons et al. |
| 2008/0210473 | A1 | 9/2008 | Zhang et al. |
| 2008/0216383 | A1 | 9/2008 | Pierick et al. |
| 2008/0223586 | A1 | 9/2008 | Barnett |
| 2008/0223587 | A1 | 9/2008 | Cherewyk |
| 2008/0236829 | A1 | 10/2008 | Lynde |
| 2008/0248205 | A1 | 10/2008 | Blanchet et al. |
| 2008/0277109 | A1 | 11/2008 | Vaidya |
| 2008/0277980 | A1 | 11/2008 | Koda et al. |
| 2008/0282924 | A1 | 11/2008 | Saenger et al. |
| 2008/0296024 | A1 | 12/2008 | Huang et al. |
| 2008/0314581 | A1 | 12/2008 | Brown |
| 2008/0314588 | A1 | 12/2008 | Langlais et al. |
| 2009/0038858 | A1 | 2/2009 | Griffo et al. |
| 2009/0044946 | A1 | 2/2009 | Schasteen et al. |
| 2009/0044949 | A1 | 2/2009 | King et al. |
| 2009/0050334 | A1 | 2/2009 | Marya et al. |
| 2009/0056934 | A1 | 3/2009 | Xu |
| 2009/0065216 | A1 | 3/2009 | Frazier |
| 2009/0084553 | A1 | 4/2009 | Rytlewski et al. |
| 2009/0084556 | A1 | 4/2009 | Richards et al. |
| 2009/0084600 | A1 | 4/2009 | Severance |

(56) References Cited

U.S. PATENT DOCUMENTS

| | | | |
|---|---|---|---|
| 2009/0090440 | A1 | 4/2009 | Kellett et al. |
| 2009/0107684 | A1 | 4/2009 | Cooke, Jr. |
| 2009/0114381 | A1 | 5/2009 | Stroobants |
| 2009/0114382 | A1 | 5/2009 | Grove et al. |
| 2009/0145666 | A1 | 6/2009 | Radford et al. |
| 2009/0151949 | A1 | 6/2009 | Marya et al. |
| 2009/0152009 | A1 | 6/2009 | Slay et al. |
| 2009/0155616 | A1 | 6/2009 | Thamida et al. |
| 2009/0159289 | A1 | 6/2009 | Avant et al. |
| 2009/0178808 | A1 | 7/2009 | Williamson et al. |
| 2009/0194273 | A1 | 8/2009 | Surjaatmadja et al. |
| 2009/0205841 | A1 | 8/2009 | Kluge et al. |
| 2009/0226340 | A1 | 9/2009 | Marya |
| 2009/0226704 | A1 | 9/2009 | Kauppinen et al. |
| 2009/0242202 | A1 | 10/2009 | Rispler et al. |
| 2009/0242208 | A1 | 10/2009 | Bolding |
| 2009/0242214 | A1 | 10/2009 | Foster et al. |
| 2009/0255667 | A1 | 10/2009 | Clem et al. |
| 2009/0255684 | A1 | 10/2009 | Bolding |
| 2009/0255686 | A1 | 10/2009 | Richard et al. |
| 2009/0260817 | A1 | 10/2009 | Gambier et al. |
| 2009/0266548 | A1 | 10/2009 | Olsen et al. |
| 2009/0272544 | A1 | 11/2009 | Giroux et al. |
| 2009/0283270 | A1 | 11/2009 | Langeslag |
| 2009/0293672 | A1 | 12/2009 | Mirchandani et al. |
| 2009/0301730 | A1 | 12/2009 | Gweily |
| 2009/0305131 | A1 | 12/2009 | Kumar et al. |
| 2009/0308588 | A1 | 12/2009 | Howell et al. |
| 2009/0317556 | A1 | 12/2009 | Macary |
| 2010/0003536 | A1 | 1/2010 | Smith et al. |
| 2010/0012385 | A1 | 1/2010 | Drivdahl et al. |
| 2010/0015002 | A1 | 1/2010 | Barrera et al. |
| 2010/0015469 | A1 | 1/2010 | Romanowski et al. |
| 2010/0025255 | A1 | 2/2010 | Su et al. |
| 2010/0032151 | A1 | 2/2010 | Duphorne |
| 2010/0040180 | A1 | 2/2010 | Kim et al. |
| 2010/0044041 | A1 | 2/2010 | Smith et al. |
| 2010/0051278 | A1 | 3/2010 | Mytopher et al. |
| 2010/0055491 | A1 | 3/2010 | Vecchio et al. |
| 2010/0055492 | A1 | 3/2010 | Barsoum et al. |
| 2010/0089583 | A1 | 4/2010 | Xu et al. |
| 2010/0089587 | A1 | 4/2010 | Stout |
| 2010/0101803 | A1 | 4/2010 | Clayton et al. |
| 2010/0122817 | A1 | 5/2010 | Surjaatmadja et al. |
| 2010/0139930 | A1 | 6/2010 | Patel et al. |
| 2010/0200230 | A1 | 8/2010 | East, Jr. et al. |
| 2010/0236793 | A1 | 9/2010 | Bjorgum |
| 2010/0236794 | A1 | 9/2010 | Duan et al. |
| 2010/0243254 | A1 | 9/2010 | Murphy et al. |
| 2010/0252273 | A1 | 10/2010 | Duphorne |
| 2010/0252280 | A1 | 10/2010 | Swor et al. |
| 2010/0270031 | A1 | 10/2010 | Patel |
| 2010/0276136 | A1 | 11/2010 | Evans et al. |
| 2010/0282338 | A1 | 11/2010 | Gerrard et al. |
| 2010/0282469 | A1 | 11/2010 | Richard et al. |
| 2010/0294510 | A1 | 11/2010 | Holmes |
| 2010/0319870 | A1 | 12/2010 | Bewlay et al. |
| 2011/0005773 | A1 | 1/2011 | Dusterhoft et al. |
| 2011/0036592 | A1 | 2/2011 | Fay |
| 2011/0048743 | A1 | 3/2011 | Stafford et al. |
| 2011/0056692 | A1 | 3/2011 | Lopez de Cardenas et al. |
| 2011/0056702 | A1 | 3/2011 | Sharma et al. |
| 2011/0067872 | A1 | 3/2011 | Agrawal |
| 2011/0067889 | A1 | 3/2011 | Marya et al. |
| 2011/0067890 | A1 | 3/2011 | Themig |
| 2011/0094406 | A1 | 4/2011 | Marya et al. |
| 2011/0100643 | A1 | 5/2011 | Themig et al. |
| 2011/0127044 | A1 | 6/2011 | Radford et al. |
| 2011/0132143 | A1 | 6/2011 | Xu et al. |
| 2011/0132612 | A1 | 6/2011 | Agrawal et al. |
| 2011/0132619 | A1 | 6/2011 | Agrawal et al. |
| 2011/0132620 | A1 | 6/2011 | Agrawal et al. |
| 2011/0132621 | A1 | 6/2011 | Agrawal et al. |
| 2011/0135530 | A1 | 6/2011 | Xu et al. |
| 2011/0135805 | A1 | 6/2011 | Doucet et al. |
| 2011/0135953 | A1 | 6/2011 | Xu et al. |
| 2011/0136707 | A1 | 6/2011 | Xu et al. |
| 2011/0139465 | A1 | 6/2011 | Tibbles et al. |
| 2011/0147014 | A1 | 6/2011 | Chen et al. |
| 2011/0186306 | A1 | 8/2011 | Marya et al. |
| 2011/0214881 | A1 | 9/2011 | Newton et al. |
| 2011/0247833 | A1 | 10/2011 | Todd et al. |
| 2011/0253387 | A1 | 10/2011 | Ervin |
| 2011/0256356 | A1 | 10/2011 | Tomantschger et al. |
| 2011/0259610 | A1 | 10/2011 | Shkurti et al. |
| 2011/0277987 | A1 | 11/2011 | Frazier |
| 2011/0277989 | A1 | 11/2011 | Frazier |
| 2011/0284232 | A1 | 11/2011 | Huang |
| 2011/0284240 | A1 | 11/2011 | Chen et al. |
| 2011/0284243 | A1 | 11/2011 | Frazier |
| 2011/0300403 | A1 | 12/2011 | Vecchio et al. |
| 2012/0067426 | A1 | 3/2012 | Soni et al. |
| 2012/0103135 | A1 | 5/2012 | Xu et al. |
| 2012/0107590 | A1 | 5/2012 | Xu et al. |
| 2012/0118583 | A1 | 5/2012 | Johnson et al. |
| 2012/0130470 | A1 | 5/2012 | Agnew et al. |
| 2012/0145389 | A1 | 6/2012 | Fitzpatrick, Jr. |
| 2012/0168152 | A1 | 7/2012 | Casciaro |
| 2012/0211239 | A1 | 8/2012 | Kritzler et al. |
| 2012/0267101 | A1 | 10/2012 | Cooke |
| 2012/0292053 | A1 | 11/2012 | Xu et al. |
| 2012/0318513 | A1 | 12/2012 | Mazyar et al. |
| 2013/0004847 | A1 | 1/2013 | Kumar et al. |
| 2013/0025409 | A1 | 1/2013 | Xu |
| 2013/0032357 | A1* | 2/2013 | Mazyar et al. ..... 166/376 |
| 2013/0048304 | A1 | 2/2013 | Agrawal et al. |
| 2013/0052472 | A1 | 2/2013 | Xu |
| 2013/0081814 | A1* | 4/2013 | Gaudette et al. ..... 166/297 |
| 2013/0105159 | A1 | 5/2013 | Alvarez et al. |
| 2013/0126190 | A1 | 5/2013 | Mazyar et al. |
| 2013/0133897 | A1 | 5/2013 | Baihly et al. |
| 2013/0146144 | A1 | 6/2013 | Joseph et al. |
| 2013/0146302 | A1* | 6/2013 | Gaudette et al. ..... 166/376 |
| 2013/0186626 | A1* | 7/2013 | Aitken et al. ..... 166/285 |
| 2013/0240203 | A1 | 9/2013 | Frazier |
| 2013/0327540 | A1* | 12/2013 | Hamid et al. ..... 166/376 |
| 2014/0116711 | A1 | 5/2014 | Tang et al. |

FOREIGN PATENT DOCUMENTS

| | | | |
|---|---|---|---|
| CN | 101050417 | A | 10/2007 |
| CN | 101351523 | A | 1/2009 |
| CN | 101457321 | A | 6/2010 |
| EP | 0033625 | A1 | 8/1981 |
| EP | 1798301 | A1 | 8/2006 |
| EP | 1857570 | A2 | 11/2007 |
| GB | 912956 | | 12/1962 |
| JP | 61067770 | | 4/1986 |
| JP | 07-54008 | A | 2/1995 |
| JP | 08232029 | | 9/1996 |
| JP | 2000185725 | | 7/2000 |
| JP | 2004225084 | | 8/2004 |
| JP | 2004225765 | A | 8/2004 |
| JP | 2005076052 | A | 3/2005 |
| JP | 2010502840 | A | 1/2010 |
| KR | 95-0014350 | B1 | 11/1995 |
| WO | 9947726 | | 9/1999 |
| WO | 2008034042 | A3 | 3/2008 |
| WO | 2008057045 | A1 | 5/2008 |
| WO | 2008079777 | A3 | 7/2008 |
| WO | WO2008079485 | | 7/2008 |
| WO | 2009079745 | A1 | 7/2009 |
| WO | 2011071902 | A3 | 6/2011 |
| WO | 2011071910 | A3 | 6/2011 |
| WO | 2012174101 | A2 | 12/2012 |
| WO | 2013053057 | A1 | 4/2013 |
| WO | 2013078031 | A1 | 5/2013 |

OTHER PUBLICATIONS

Canadian Pat. App. No. 2783241 filed on Dec. 7, 2010, published on Jun. 16, 2011 for "Nanomatrix Powder Metal Compact".

Canadian Pat. App. No. 2783346 filed on Dec. 7, 2010, published on Jun. 16, 2011 for "Engineered Powder Compact Composite Material".

(56) References Cited

OTHER PUBLICATIONS

International Search Report and Written Opinion of the International Searching Authority, or the Declaration for PCT/US2011/058105 mailed from the Korean Intellectual Property Office on May 1, 2012.
International Search Report and Written Opinion of the International Searching Authority for International Application No. PCT/US2011/058099 (filed on Oct. 27, 2011), mailed on May 11, 2012.
Patent Cooperation Treaty International Search Report and Written Opinion for International Patent Application No. PCT/US2012/034978 filed on Apr. 25, 2012, mailed on Nov. 12, 2012.
Abdoulaye Seyni, Nadine Le Bolay, Sonia Molina-Boisseau, "On the interest of using degradable fillers in co-ground composite materials", Powder Technology 190, (2009) pp. 176-184.
Ambat, et al.; "Electroless Nickel-Plating on AZ91D Magnesium Alloy: Effect of Substrate Microstructure and Plating Parameters"; Surface and Coatings Technology; 179; pp. 124-134; (2004).
Baker Hughes Tools. "Baker Oil Tools Introduces Revolutionary Sand Control Completion Technology," May 2, 2005.
E. Paul Bercegeay et al., "A One-Trip Gravel Packing System"; Society of Petroleum Engineers, Offshort Technology Conference, SPE Paper No. 4771; Feb. 7-8, 1974.
Bybee, Karen. "One-Trip Completion System Eliminates Perforations," Completions Today, Sep. 2007, pp. 52-53.
Ch. Christoglou, N. Voudouris, G.N. Angelopoulos, M. Pant, W. Dahl, "Deposition of Aluminum on Magnesium by a CVD Process", Surface and Coatings Technology 184 (2004) 149-155.
Chang, et al.; "Electrodeposition of Aluminum on Magnesium Alloy in Aluminum Chloride (A1C13)-1-ethyl-3-methylimidazolium chloride (EMIC) Ionic Liquid and Its Corrosion Behavior"; Electrochemistry Communications; 9; pp. 1602-1606; (2007).
Chun-Lin, Li. "Design of Abrasive Water Jet Perforation and Hydraulic Fracturing Tool," Oil Field Equipment, Mar. 2011.
Constantin Vahlas, Bri Gitte Caussat, Philippe Serp, George N. Angelopoulos, "Principles and Applications of CVD Powder Technology", Materials Science and Engineering R 53 (2006) 1-72.
Curtin, William and Brian Sheldon. "CNT-reinforced ceramics and metals," Materials Today, 2004, vol. 7, 44-49.
Yi Feng, Hailong Yuan, "Electroless Plating of Carbon Nanotubes with Silver" Journal of Materials Science, 39, (2004) pp. 3241-3243.
E. Flahaut et al., "Carbon Nanotube-Metal—Oxide Nanocomposites: Microstructure, Electrical Conductivity and Mechanical Properties" Acta mater. 48 (2000) 3803-3812.
Flow Control Systems, [online]; [retrieved on May 20, 2010]; retrieved from the Internet http://www.bakerhughes.com/products-and-services/completions-and-productions/well-completions/packers-and-flow-control/flow-control-systems.
Forsyth, et al.; "An Ionic Liquid Surface Treatment for Corrosion Protection of Magnesium Alloy AZ31"; Electrochem. Solid-State Lett./ 9(11); Abstract only; 1 page.
Forsyth, et al.; "Exploring Corrosion Protection of Mg Via Ionic Liquid Pretreatment"; Surface & Coatings Technology; 201; pp. 4496-4504; (2007).
Galanty et al. "Consolidation of metal powders during the extrusion process," Journal of Materials Processing Technology (2002), pp. 491-496.
C.S. Goh, J. Wei, L C Lee, and M. Gupta, "Development of novel carbon nanotube reinforced magnesium nanocomposites using the powder metallurgy technique", Nanotechnology 17 (2006) 7-12.
Guan Ling Song, Andrej Atrens "Corrosion Mechanisms of Magnesium Alloys", Advanced Engineering Materials 1999, 1, No. 1, pp. 11-33.
H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.
Hjortstam et al. "Can we achieve ultra-low resistivity in carbon nanotube-based metal composites," Applied Physics A (2004), vol. 78, Issue 8, pp. 1175-1179.
Hsiao et al.; "Effect of Heat Treatment on Anodization and Electrochemical Behavior of AZ91D Magnesium Alloy"; J. Mater. Res.; 20(10); pp. 2763-2771;(2005).
Hsiao, et al.; "Anodization of AZ91D Magnesium Alloy in Silicate-Containing Electrolytes"; Surface & Coatings Technology; 199; pp. 127-134; (2005).
Hsiao, et al.; "Baking Treatment Effect on Materials Characteristics and Electrochemical Behavior of anodic Film Formed on AZ91D Magnesium Alloy"; Corrosion Science; 49; pp. 781-793; (2007).
Hsiao, et al.; "Characterization of Anodic Films Formed on AZ91D Magnesium Alloy"; Surface & Coatings Technology; 190; pp. 299-308; (2005).
Huo et al.; "Corrosion of AZ91D Magnesium Alloy with a Chemical Conversion Coating and Electroless Nickel Layer"; Corrosion Science: 46; pp. 1467-1477; (2004).
International Search Report and Written Opinion; Mail Date Jul. 28, 2011; Internal Applilcatio No. PCT/US2010/057763; International Filing date Nov. 23, 2010; Korean Intellectual Property Office; International Search Report 7 pages; Written Opinion 3 pages.
Notification of Transmittal of the International Search Report and the Written Opinion of the International Searching Authority; PCT/US2010/059257; Korean Intellectual Property Office; Mailed Jul. 27, 2011.
Notification of Transmittal of the International Search Report and the Written Opinion of the International Searching Authority; PCT/US2010/059259; International Searching Authority KIPO; Mailed Jun. 13, 2011.
Notification of Transmittal of the International Search Report and the Written Opinion of the International Searching Authority; PCT/US2010/059265; International Searching Authority KIPO; Mailed Jun. 16, 2011.
Notification of Transmittal of The International Search Report and the Written Opinion of the International Searching Authority; PCT/US2010/059268; International Searching Authority KIPO; Mailed Jun. 17, 2011.
Notification of Transmittal of the International Search Report and the Written Opinion of the International Searching Authority; PCT/US2011/047000; Korean Intellectual Property Office; Mailed Dec. 26, 2011; 8 pages.
J. Dutta Majumdar, B. Ramesh Chandra, B.L. Mordike, R. Galun, I. Manna, "Laser Surface Engineering of a Magnesium Alloy with Al + Al2O3", Surface and Coatings Technology 179 (2004) 297-305.
J.E. Gray, B. Luan, "Protective Coatings on Magnesium and Its Alloys—a Critical Review", Journal of Alloys and Compounds 336 (2002) 88-113.
Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.
Liu, et al.; "Electroless Nickel Plating on AZ91 Mg Alloy Substrate"; Surface & Coatings Technology; 200; pp. 5087-5093; (2006).
Lunder et al.; "The Role of Mg17Al12 Phase in the Corrosion of Mg Alloy AZ91"; Corrosion; 45(9); pp. 741-748; (1989).
Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.
Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.
Optisleeve Sliding Sleeve, [online]; [retrieved on Jun. 25, 2010]; retrieved from the Internet weatherford.com/weatherford/groups/.../weatherfordcorp/WFT033159.pdf.
Pardo, et al.; "Corrosion Behaviour of Magnesium/Aluminium Alloys in 3.5 wt% NaC1"; Corrosion Science; 50; pp. 823-834; (2008).
Notification of Transmittal of the International Search Report and Written Opinion, Mailed Jul. 8, 2011, International Appln. No. PCT/US2010/059263, Written Opinion 4 pages, International Search Report 3 pages.

(56) References Cited

OTHER PUBLICATIONS

Shi et al.; "Influence of the Beta Phase on the Corrosion Performance of Anodised Coatings on Magnesium—Aluminium Alloys"; Corrosion Science; 47; pp. 2760-2777; (2005).
Shimizu et al., "Multi-walled carbon nanotube-reinforced magnesium alloy composites", Scripta Materialia, vol. 58, Issue 4, pp. 267-270.
"Sliding Sleeve", Omega Completion Technology Ltd, Sep. 29, 2009, retrieved on: www.omega-completion.com.
Song, et al.; "Corrosion Mechanisms of Magnesium Alloys"; Advanced Engineering Materials; 1(1); pp. 11-33; (1999).
Song, G. and S. Song. "A Possible Biodegradable Magnesium Implant Material," Advanced Engineering Materials, vol. 9, Issue 4, Apr. 2007, pp. 298-302.
Song, Guangling; "Recent Progress in Corrosion and Protection of Magnesium Alloys"; Advanced Engineering Materials; 7(7); pp. 563-586; (2005).
Song, et al.; "Influence of Microstructure on the Corrosion of Diecast AZ91D"; Corrosion Science; 41; pp. 249-273; (1999).
Song, et al.; "Corrosion Behaviour of AZ21, AZ501 and AZ91 in Sodium Chloride"; Corrosion Science; 40(10); pp. 1769-1791; (1998).
Song, et al.; "Understanding Magnesium Corrosion"; Advanced Engineering Materials; 5; No. 12; pp. 837-858; (2003).
Notification of Transmittal of the International Search Report and the Written Opinion of the International Searching Authority, or the Declaration mailed on Feb. 23, 2012 (Dated Feb. 22, 2012) for PCT/US2011/043036.
A. Elsayed et al., "Effect of Consolidation and Extrusion Temperatures on Tensile Properties of Hot Extruded ZK61 Magnesium Alloy Gas Atomized Powders via Spark Plasma Sintering", Transaction of JWRI, vol. 38, (2009) No. 2, pp. 31-35.
A. Maisano, "Cryomilling of Aluminum-Based and Magnesium-Based Metal Powders", Thesis, Virginia Tech, Jan. 13, 2006.
B. Han et al., "Mechanical Properties of Nanostructured Materials", Rev. Adv. Mater. Sci. 9(2005) 1-16.
Baker Oil Tools. "Z-Seal Metal-to-Metal Expandable Sealing Device Uses Expanding Metal in Place of Elastomers," Nov. 6, 2006.
E. Lavernia, et al., "Cryomilled nanostructured materials: Processing and properties", Materials Science and Engineering A, 493, (2008) 207-214.
H. Vickery et al., "New One-Trip Multi-Zone Frac Pack System with Positive Positioning." European Petroleum Conference, Oct. 29-31, 2002, Aberdeen, UK. [Abstract Only].
H. Watanabe et al., "Superplastic Deformation Mechanism in Powder Metallurgy Magnesium Alloys and Composites", Acta mater. 49 (2001) pp. 2027-2037.
H. Watarai, "Trend of research and development for magnesium alloys-reducing the weight of structural materials in motor vehicles", Science and Technology Trends, Quarterly Review No. 18, 84-97, (2006).
ISR and Written Opinion for PCT/US2012/049434, Date of Mailing Feb. 1, 2013.
ISR and Written Opinion for PCT Application No. PCT/US2012/044866, dated Jan. 1, 2013.
ISR and Written Opinion for PCT/US2012/046231, Date of Mailing Jan. 29, 2013.
J. Constantine, "Selective Production of Horizontal Openhole Completions Using ECP and Sliding Sleeve Technology." SPE Rocky Mountain Regional Meeting, May 15-18, 1999, Gillette, Wyoming. [Abstract Only].
M. Bououdina, et al., "Comparative study of mechanical alloying of (Mg+Al) and (Mg+Al+Ni) mixtures for hydrogen storage", Journal of Alloys and Compounds, 2002, 336, 222-231.
M. Liu, et al., "Calculated phase diagrams and the corrosion of die-cast Mg-Al alloys", Corrosion Science, 2009, 51, 606-619.
ISR and Written Opinion of PCT/US2012/038622; Date of Mailing Dec. 6, 2012.
S. Lee, et al., "Effects of Ni addition on hydrogen storage properties of Mg17AL12 alloy", Materials Chemistry and Physics, 2011, 126, 319-324.
Shumbera et al., "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003, Denver, Colorado. [Abstract Only].
T. Bastow, et al., "Clustering and formation of nano-precipitates in dilute aluminum and magnesium alloys", Materials science and Engineering, 2003, C23, 757-762.
Shimizu et al., "Multi-walled carbon nanotube-reinforced magnesium alloy composites", Scripta Materialia, vol. 58, Issue 4, pp. 267-270, (2008).
Wikipedia, the free encyclopedia. Reactivity series. http://en.wikipedia.org/w/index.php?title=Reactivity_series&printable=yes downloaded on May 18, 2014. 8 pages.
Adams, et al., "Thermal stabilities of aromatic acids as geothermal tracers", Geothermics, vol. 21, No. 3, 1992, pp. 323-339.
Ayman, et al.; "Effect of Consolidation and Extrusion Temperatures on Tensile Properties of Hot Extruded ZK61 Magnesium Alloy Gas Atomized Powders via Spark Plasma Sintering", Transactions of JWRI, vol. 38 (2009), No. 2, pp. 1-5.
Carrejo, et al., "Improving Flow Assurance in Multi-Zone Facturing Treatments in Hydrocarben Reservoirs with High Strength Corrodible Tripping Balls"; Society of Petroleum Engineers; SPE Paper No. 151613; Apr. 16, 2012; 6 pages.
Garfield, New One-Trip Sand-Control Completion System that Eliminates Formation Damage Resulting From conventional Perforating and Gravel-Packing Operations; SPE Annual Technical Conference and Exhibition, Oct. 9-12, 2005.
Garfield, et al., "Maximizing Inflow Performance in Soft Sand Completion Using New One-trip Sand Control Liner Completion Technology", SPE European Formation Damage Conference, May 25-27, 2005.
International Search Report and Written Opinion; International Application No. PCT/US/2012/053339; International Filing Date: Aug. 31, 2012; Date of Mailing: Feb. 15, 2013; 11 pages.
International Search Report and Written Opinion; International Application No. PCT/US2012/053342; International Filing Date: Aug. 31, 2012; Date of Mailing: Feb. 19, 2013; 9 pages.
International Search Report and Written Opinion; International Application No. PCT/US2012/053350; International Filing Date: Aug. 31, 2012; Date of Mailing: Feb. 25, 2013; 10 pages.
International Search Report and Written Opinion; International Application No. PCT/US2014/049347; International Filing Date: Aug. 1, 2014; Date of Mailing: Nov. 24, 2014; 11 pages.
International Search Report and Written Opinion; International Application No. PCT/US2014/054720; International Filing Date: Sep. 9, 2014; Date of Mailing: Dec. 17, 2014; 10 pages.
Rose, et al.; "The application of the polyaromatic sulfonates as tracers in geothermal reservoirs", Geothermics 30 (2001) pp. 617-640.
Shaw, "Benefits and Application of a Surface-Controlled Sliding Sleeve for Fracturing Operations"; Society of Petroleum Engineers, SPE Paper No. 147546; Oct. 30, 2011; 8 pages.
Shigematsu, et al., "Surface Treatment of AZ91D Magnesium Alloy by Aluminum diffusion Coating", Journal of Materials Science Letters 19, 2000, pp. 473-475.
Singh, et al., "Extended Homogeneity Range of Intermetallic Phases in Mechanically Alloyed Mg-Al Alloys", Elsevier Sciences Ltd., Intemetallics 11, 2003, pp. 373-376.
Stanley, et al.; "An Introduction to Ground-Water Tracers", Department of Hydrology and Water Resources, University of Arizona, Mar. 1985, pp. 1-219.
Walters, et al.; "A Study of Jets from Unsintered-Powder Metal Lined Nonprecision Small-Caliber Shaped Charges", Army Research Laboratory, Aberdeen Proving Ground, MD 21005-5066; Feb. 2001.
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zemel, "Tracers in the Oil Field", University of Texas at Austin, Center for Petroleum and Geosystems, Jan. 1995, Chapters 1, 2, 3, 7.

(56) References Cited

OTHER PUBLICATIONS

Zhang, et al.; "High Strength Nanostructured Materials and Their Oil Field Applications"; Society of Petroleum Engineers; Conference Paper SPE 157092; SPE International Oilfield Nanotechnology Conference, 2012; 6 pages.
Baker Hughes Incorporated. IN-Tallic Disintegrating Frac Balls. Houston: Baker Hughes Incorporated, 2011. Accessed Mar. 6, 2015.
Baker Hughes, "Multistage", Oct. 31, 2011, BakerHughes.com; accessed Mar. 6, 2015.
International Search Report and Written Opinion; International Application No. PCT/US2012/071742; International Filing Date: Dec. 27, 2012; Date of Mailing: Apr. 22, 2013; 12 pages.
International Search Report and Written Opinion; International Application No. PCT/US20141058997, International Filing Date: Oct. 3, 2014; Date of Mailing: Jan. 12, 2015; 12 pages.
International Search Report; International Application No. PCT/US2012/044229, International Filing Date: Jun. 26, 2012; Date of Mailing; Jan. 30, 2013; 3 pages.
Murray, "Binary Alloy Phase Diagrams" Int. Met. Rev., 30(5) 1985 vol. 1, pp. 103-187.
Vernon Constien et al., "Development of Reactive Coatings to Protect Sand-Control Screens", SPE 112494, Copyright 2008, Society of Petroleum Engineers, Presented at the 2008 SPE International Symposium and Exhibition on Formation Damage Control.

* cited by examiner

SELECTIVELY CORRODIBLE DOWNHOLE ARTICLE AND METHOD OF USE

BACKGROUND

Certain downhole operations involve placement of elements in a downhole environment, where the element performs its function, and is then removed. For example, elements such as ball/ball seat assemblies and fracture (frac) plugs are downhole elements used to seal off lower zones in a borehole in order to carry out a hydraulic fracturing process (also referred to in the art as "fracking") to break up different zones of reservoir rock. After the fracking operation, the ball/ball seat or plugs are then removed to allow, inter alia, fluid flow to or from the fractured rock.

Balls and/or ball seats, and frac plugs, can be formed of a corrodible material so that they need not be physically removed intact from the downhole environment. In this way, when the operation involving the ball/ball seat or frac plug is completed, the ball, ball seat, and/or frac plug is dissolved away. Otherwise, the downhole article may have to remain in the hole for a longer period than is necessary for the operation.

To facilitate removal, such elements can be formed of a material that reacts with the ambient downhole environment so that they need not be physically removed by, for example, a mechanical operation, but instead corrode or dissolve in the downhole environment. In order to employ dissolution or corrosion to remove downhole elements, it is very desirable to develop downhole articles and methods of their use whereby the dissolution or corrosion and removal of these elements may be selectively controlled.

SUMMARY

In an exemplary embodiment, a selectively corrodible downhole article is disclosed. The article includes a movable cylindrical member comprising a first section and an axially separated second section, the first section comprising a first material having a first galvanic activity, the second section comprising a second material having a second galvanic activity, the first galvanic activity being greater than the second galvanic activity, the first section being electrically isolated from the second section. The article also includes a fixed member disposed on the cylindrical member and configured for electrical contact with the first section or the second section, the fixed member comprising an intermediate material having an intermediate galvanic activity, the intermediate galvanic activity being intermediate the first galvanic activity and the second galvanic activity, the movable cylindrical member configured for movement from a first position where the first section is disposed on and in electrical contact with the fixed member and a second position where the second section is disposed on and in electrical contact with the fixed member, wherein in the first position, the first section is configured for selective dissolution, and wherein in the second position, the fixed member is configured for selective dissolution.

In another exemplary embodiment, a method of removing a selectively corrodible downhole article is disclosed. The method includes disposing downhole a selectively corrodible downhole article, comprising: a movable cylindrical member comprising a first section and an axially separated second section, the first section comprising a first material having a first galvanic activity, the second section comprising a second material having a second galvanic activity, the first galvanic activity being greater than the second galvanic activity, the first section being electrically isolated from the second section; and a fixed member disposed on the cylindrical member and configured for electrical contact with the first section or the second section, the fixed member comprising an intermediate material having an intermediate galvanic activity, the intermediate galvanic activity being intermediate the first galvanic activity and the second galvanic activity, the movable cylindrical member configured for movement from a first position where the first section is disposed on and in electrical contact with the fixed member and a second position where the second section is disposed on and in electrical contact with the fixed member, wherein in the first position, the first section is configured for selective dissolution, and wherein in the second position, the fixed member is configured for selective dissolution. The method also includes exposing the selectively corrodible downhole article to a first wellbore fluid while the movable cylindrical member is in the first position, wherein the first section is selectively dissolved. The method further includes moving the movable cylindrical member to the second position and exposing the selectively corrodible metallic downhole article to a second wellbore fluid, wherein the fixed member is selectively dissolved.

BRIEF DESCRIPTION OF THE DRAWINGS

Referring now to the drawings wherein like elements are numbered alike in the several Figures.

DETAILED DESCRIPTION OF THE INVENTION

Figure 2A:
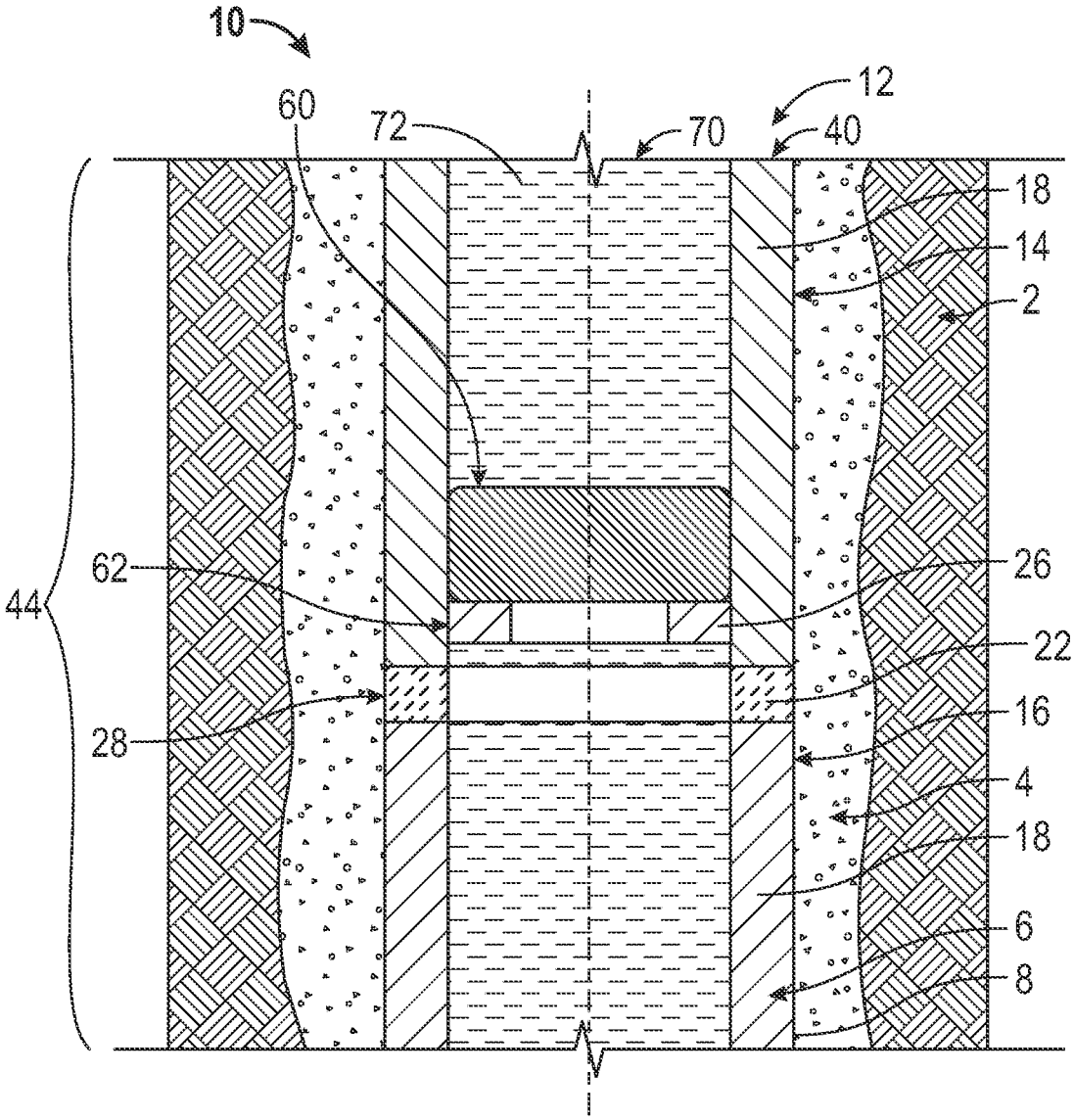
FIG. 2A is a cross-sectional view of an exemplary embodiment of a selectively corrodible downhole article comprising a plug, plug seat and movable tubular article in a first position as disclosed herein.
Figure 2B:
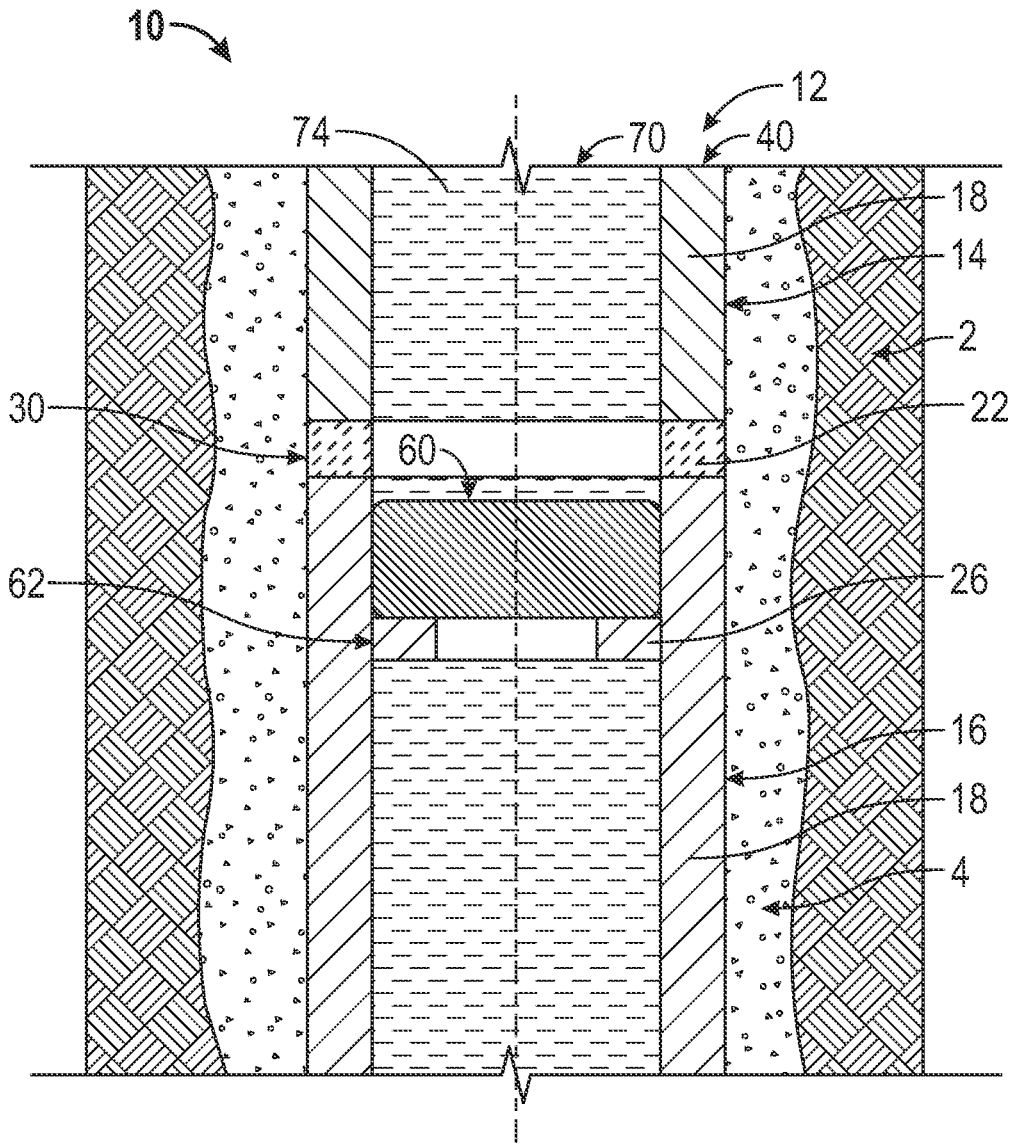
FIG. 2B is a cross-sectional view of the exemplary embodiment of a selectively corrodible downhole article of FIG. 2A with the movable tubular article in a second position as disclosed herein.
Figure 3:
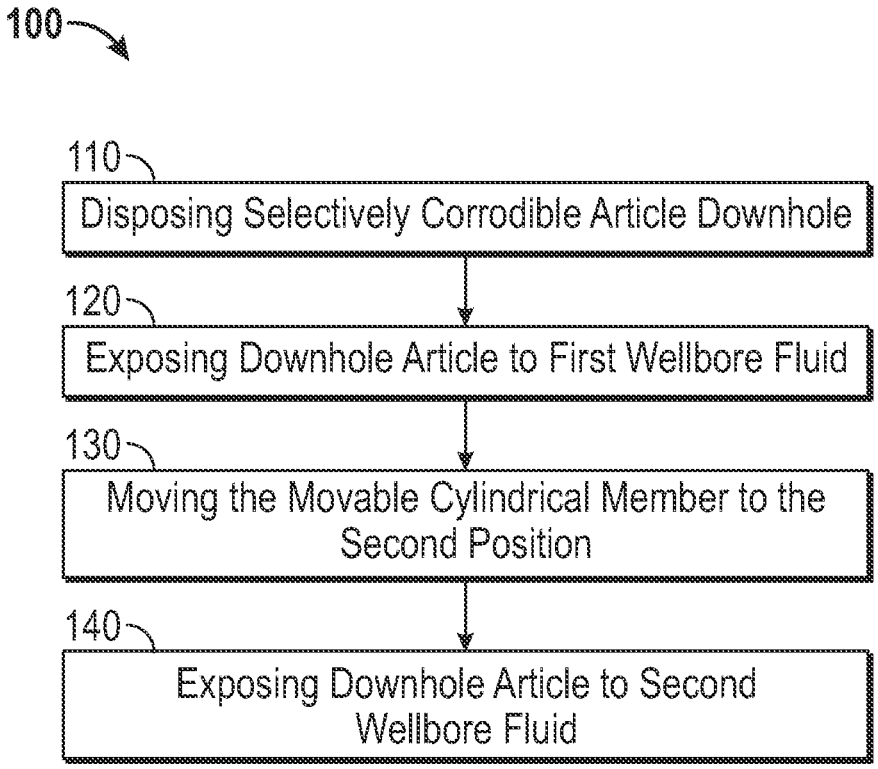
FIG. 3 is a flowchart of an exemplary embodiment of a method of removing a selectively corrodible downhole article.

Referring to the figures, and particularly FIGS. 1-3, a method 100 of removing a selectively corrodible downhole article 10 from a wellbore 70 is disclosed. The wellbore 70 may be formed in an earth formation 2 and may include a cement casing 4. The wellbore may also include a liner 6, which may include a plurality of metal tubulars (tubular sections) 8. The selectively corrodible downhole article 10 may comprise any suitable downhole article, including various downhole tools or components. In one embodiment, the selectively corrodible downhole article 10 may include a selectively corrodible ball 50 and ball seat 52, such as a frac ball and complementary ball seat, or a selectively corrodible plug 60 and plug seat 62, such as a frac plug and complementary plug seat. The article 10 is configured for selective dissolution in a suitable wellbore fluid 72, 74 acting as an electrolyte.

The article 10 includes a movable member, such as a movable cylindrical member 12, comprising a first section 14 and an axially separated second section 16. The first section 14 comprising a first material 18 having a first galvanic activity. The second section 16 includes a second material 20 having a second galvanic activity. The first galvanic activity is greater than the second galvanic activity, such that it has a greater tendency to corrode in a given wellbore fluid as an electrolyte. The first section 14 is electrically isolated from the second section 16. Electrical isolation may be accomplished by any suitable electrical isolator 22. A suitable electrical isolator may include any suitable electrically insulating material, particularly an electrically insulating polymer or ceramic, or a combination thereof.

The article 10 also includes a fixed member 24 disposed on the movable cylindrical member 12 or movable cylindrical member 12 may be disposed within fixed member 24. The movable cylindrical member 12 and fixed member 24 are both electrically conductive. The fixed member 24 is configured for electrical contact with the first section 14 or the second section 16, the fixed member 24 comprising an intermediate material 26 having an intermediate galvanic activity, the intermediate galvanic activity being intermediate the first galvanic activity and the second galvanic activity. The movable cylindrical member 12 is configured for movement from a first position 28 where the first section 14 is disposed on and in electrical contact with the fixed member 24 and a second position 30 where the second section 16 is disposed on and in electrical contact with the fixed member 24. In the first position 28, the first section 14 is configured for selective dissolution because the first material 18 is more galvanically active (i.e., is more reactive) than the intermediate material 26. In the second position, the fixed member 24 is configured for selective dissolution because the intermediate material 26 is more galvanically active than the second material 20. The first material 18, intermediate material 26 and second material 20 may each be, for example, a different metal from the galvanic series having the relative activities described herein. The first material 18, intermediate material 26 and second material 20 contact each other as described herein in the presence of a wellbore fluid that comprises an electrolyte, such as for example a brine, acidizing fluid, drilling mud or the like.

Figure 1A:
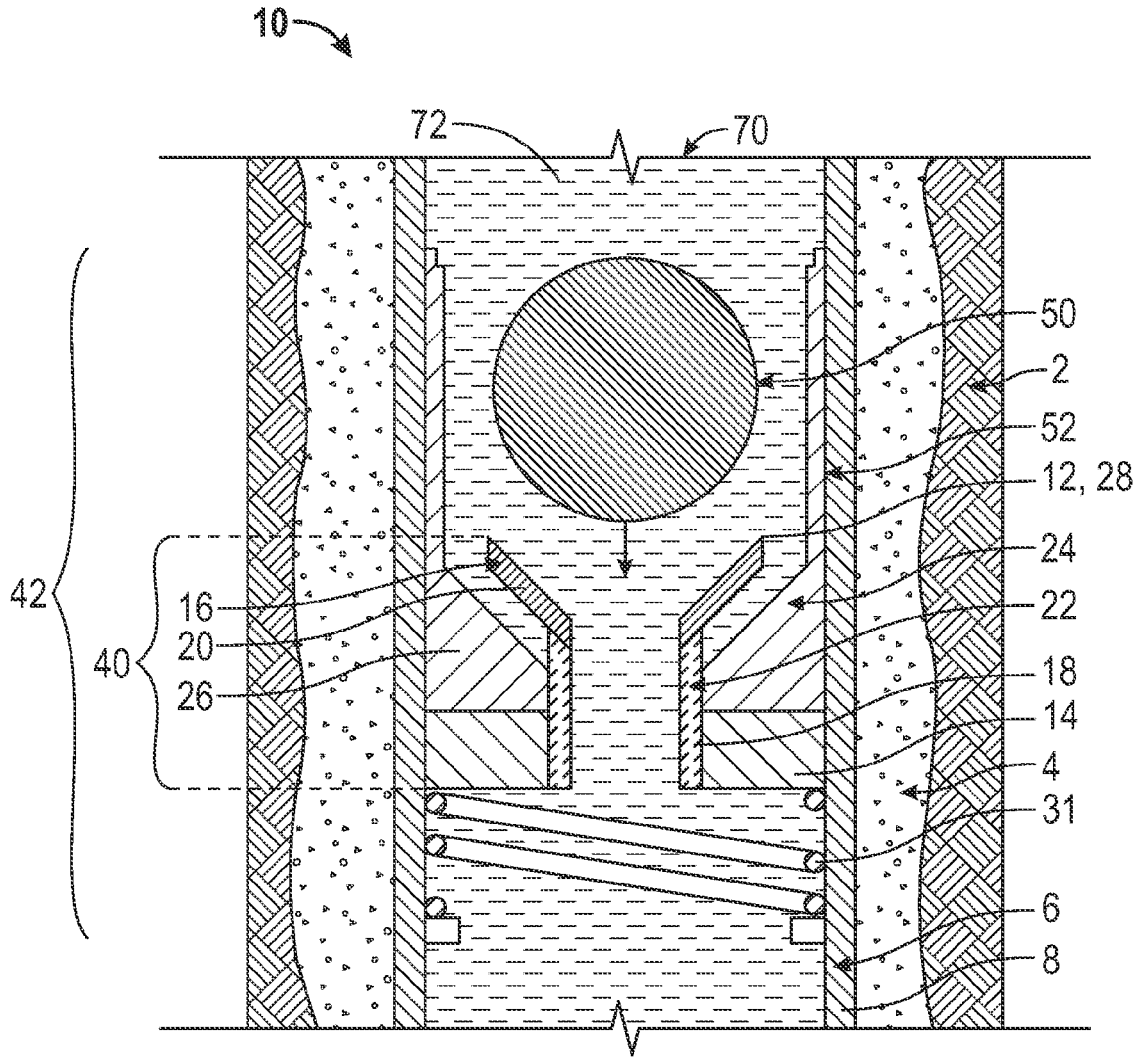
FIG. 1A is a cross-sectional view of an exemplary embodiment of a selectively corrodible downhole article comprising a ball, ball seat and movable cylindrical sleeve in a first position as disclosed herein.
Figure 1B:
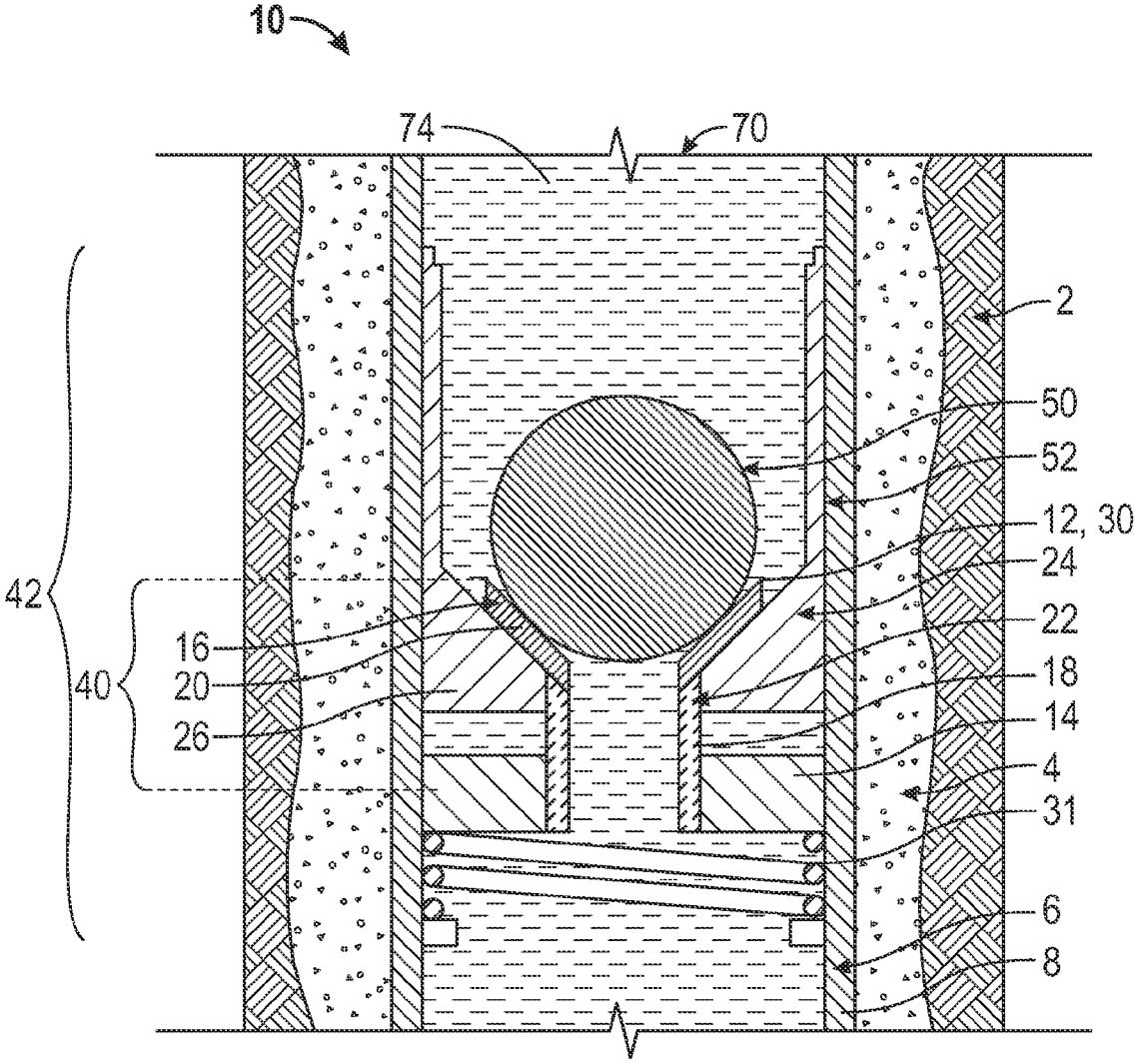
FIG. 1B is a cross-sectional view of the exemplary embodiment of a selectively corrodible downhole article of FIG. 1A with the movable cylindrical sleeve in a second position as disclosed herein.

Referring to FIGS. 1A and 1B, the selectively corrodible article 10 may include a ball 50 and ball seat 52. In one embodiment, at least one of ball 50 and ball seat 52 comprise intermediate material 26. In this embodiment, while at least one of ball 50 and ball seat 52 comprise intermediate material 26, the other of the ball 50 and ball seat 52 may include another electrically conductive material that is less galvanically active than the material intermediate material 26. For example, the ball 50 may be formed from intermediate material, and the ball seat may be formed from a less galvanically active material, such that the ball 50 is configured for removal as described herein. Alternately, the ball seat 52 may be formed from intermediate material, and the ball may be formed from a less galvanically active material, such that the ball seat 52 is configured for removal from the wellbore 70 as described herein, and the ball 50 may be allowed to fall to a lower portion of the wellbore 70. In another embodiment, both the ball 50 and ball seat 52 may comprise intermediate material 26 and are configured for removal from the wellbore 70 as described herein.

Referring to FIGS. 2A and 2B, the selectively corrodible article 10 may include a plug 60, such as a frac plug, or a plug seat 62. In one embodiment, at least one of plug 60 and plug seat 62 comprise intermediate material 26. In this embodiment, while at least one of plug 60 and plug seat 62 comprise intermediate material 26, the other of the plug or plug seat 62 may include another electrically conductive material that is less galvanically active than the material intermediate material 26. For example, the plug 60 may be formed from intermediate material, and the plug seat 62 may be formed from a less galvanically active material, such that the plug 60 is configured for removal as described herein. Alternately, the plug seat 62 may be formed from intermediate material, and the plug 60 may be formed from a less galvanically active material, such that the plug seat 62 is configured for removal from the wellbore 70 as described herein, and the plug 60 may be allowed to fall to a lower portion of the wellbore 70. In another embodiment, both the plug 60 and plug seat 62 may comprise intermediate material 26 and are configured for removal from the wellbore 70 as described herein.

Referring to FIGS. 1A and 1B, in one embodiment the movable cylindrical member 12 may include a slidable sleeve 40 disposed within a tubular article 42 that may be moved axially upwardly or downwardly within the wellbore 70. In another embodiment, the movable cylindrical member 12 may include a movable tubular article 44 that may be moved axially upwardly or downwardly within the wellbore 70, as illustrated in FIGS. 2A and 2B. While the movable cylindrical member 12 is illustrated in FIGS. 2A and 2B with the first section 14 uphole (closer to the surface) from the second section 16 (FIG. 2A), such that the movable member 12 is moved uphole (FIGS. 1B and 2B) in accordance with method 100, as described herein, it will be understood that the positions of the first section 14 and the second section 16 may be reversed, such that the first section 14 is downhole (farther from the surface) from the second section 16, such that the movable member 12 is moved downhole in accordance with method 100, as described herein and illustrated in FIGS. 1A and 1B.

Referring to FIGS. 1A and 1B, in one embodiment the slidable sleeve 40 includes a first section 14 having a shape, such as the shape of a cylindrical ring or hollow cylinder, which is configured to abut the lower surface of the ball seat 52 in intimate touching contact sufficient to establish electrical contact between them for the purposes described herein. First section 14 formed from first material 18 is attached proximate a lower end of an electrical isolator 22 that may have any suitable shape, such as a hollow cylindrical shape, and is slidably disposed within the central bore of ball seat 52 and configured to move from first position 28 (FIG. 1A) to second position 30 (FIG. 1B). Slidable sleeve 40 also includes a second section 16 having a shape, such as the shape of a hollow frustoconical disk, which is configured to sealing engage the upper seating surface of the ball seat 52 in intimate touching and sealing contact sufficient to establish electrical contact and sealing contact between them for the purposes described herein. Second section 16 formed from second material 20 is attached proximate an upper end of the electrical isolator 22. In the first position 28, the second section 16 is electrically isolated from the ball seat 52 in the presence of first wellbore fluid 72 that is configured to act as an electrolyte and first section 14 is in electrical contact with the ball seat. As described herein, the first material 18 is configured to be more galvanically active in the electrolyte than the intermediate material 26 of the ball seat 52, such that the ball seat is protected from corrosion in first position 28, and first material is configured to be selectively corroded or dissolved in the first fluid 72. First position 28 may, for example, represent preparation and configuration of a section of the wellbore for a completion operation. The first section 14 may be biased against the ball seat 52 by a bias member, such as, for example, bias spring 31. Bias spring 31 may be configured for eventual removal by an appropriate wellbore fluid, such as second wellbore fluid 74, or may be configured such that its presence in the wellbore does not substantially interfere with the intended wellbore operations. Once the wellbore has been configured, it may be desirable to perform an operation such as fracturing by insertion of a ball 50 in first wellbore fluid 72 (FIG. 1A) and pressurization of a second wellbore fluid 74 that is also configured to act as an electrolyte as shown in FIG. 1B. Pressurization of the second fluid 74 drives the ball 50 into the second section 16 thereby causing the slidable sleeve 40 to slide to second position 30 where the second section is in intimate electrical contact with the surface of ball seat 52 such that the wellbore operation may be performed in the pressurized portion of the wellbore above the seal formed between ball 50, second section 16 and ball seat 52. The first section 14 moves out of electrical contact with the ball seat 52 and ceases to provide galvanic protection afforded in the first position 28. In the second position 30, the intermediate material of the ball seat 52 and/or ball 50, for example, is more galvanically active than the second material 20 of the second section 16, thereby causing the ball seat 52 and/or ball 50 to corrode or dissolve in preparation for its eventual removal from the wellbore. The absolute and relative galvanic activity of intermediate material 26 and second material 20 may be selected to establish a predetermined time interval for performing the desired wellbore operation such as fracturing, including a predetermined interval for removal of the ball seat 52 and/or ball 50, as described herein. Since the ball seat 52 is supporting the ball 50 and slidable sleeve 40, it will be understood that its corrosion or dissolution will cause the ball 50 and slidable sleeve 40 to be removed from the location shown in the wellbore, such as by falling to a lower portion of the wellbore, such as the bottom of the wellbore.

The first material 18 may, for example, comprise any suitable corrodible, high reactivity metal. In one embodiment, the first material is magnesium, which is anodic with respect to the intermediate material 26 and second material 20. The first material 18 may includes any material suitable for use in a downhole environment, provided the first material 18 is more galvanically active in the downhole environment relative to the intermediate material 26 and second material 20. In particular, first material 18 may be selected from the materials described herein for use as intermediate material 26, so long as the first material 18 is selected to be more galvanically active than the intermediate material 26.

The intermediate material 26 may, for example, comprise a corrodible, intermediate reactivity metal. In one embodiment, the intermediate material 26 comprises magnesium, aluminum, manganese or zinc, or an alloy thereof, or a combination comprising at least one of the foregoing. Magnesium alloys include any such alloy which is corrodible in a corrosive environment including those typically encountered downhole, such as an aqueous environment which includes salt (i.e., brine), or an acidic or corrosive agent such as hydrogen sulfide, hydrochloric acid, or other such corrosive agents. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), zinc (Zn), or zirconium (Zr), or a combination comprising at least one of these elements. Particularly useful alloys can be prepared from magnesium alloy particles including those prepared from magnesium alloyed with Al, Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater accelerating effect on corrosion. Exemplary commercially available magnesium alloys which include different combinations of the above alloying elements to achieve different degrees of corrosion resistance include, but are not limited to, for example, those alloyed with aluminum, strontium, and manganese such as AJ62, AJ50x, AJ51x, and AJ52x alloys, and those alloyed with aluminum, zinc, and manganese which include AZ91A-E alloys.

It will be appreciated that alloys having corrosion rates greater than those of the above exemplary alloys are contemplated as being useful herein. For example, nickel has been found to be useful in decreasing the corrosion resistance (i.e., increasing the corrosion rate) of magnesium alloys when included in amounts less than or equal to about 0.5 wt %, specifically less than or equal to about 0.4 wt %, and more specifically less than or equal to about 0.3 wt %, to provide a useful corrosion rate for the corrodible downhole article. The above magnesium alloys are useful for forming the intermediate material 26, and may be formed into the desired shape and size by casting, forging and machining.

In one embodiment, powders of magnesium or the magnesium alloys described are useful for forming the fixed member 24 as a powder compact. The magnesium alloy powder generally has a particle size of from about 50 to about 250 micrometers (μm), and more specifically about 60 to about 140 μm. The powder may be further coated using a method such as chemical vapor deposition, anodization or the like, or admixed by physical method such as cryo-milling, ball milling, or the like, with a metal or metal oxide, nitride or carbide, such as Al, Ni, W, Co, Cu or Fe, or oxides, nitrides or carbides thereof, or an alloy thereof, or a combination thereof. The coatings may have any suitable thickness, including nanoscale coatings having an average thickness of about 5 nm to about 2500 nm. Such coated powders are referred to herein as controlled electrolytic materials (CEM). The CEM is then molded or compressed into the desired shape by, for example, cold compression or pressing using an isostatic press at about 40 to about 80 ksi (about 275 to about 550 MPa), followed by extrusion, forging, or sintering, or machining, to provide a core having the desired shape and dimensions. The CEM materials may include the cellular nanomatrix materials formed from the powder materials described, for example, in commonly assigned, co-pending U.S. application Ser. No. 12/633,682 filed on Dec. 8, 2009; U.S. application Ser. No. 13/220,824 filed on Aug. 30, 2011; U.S. application Ser. No. 13/220,832 filed on Aug. 30, 2011; and U.S. application Ser. No. 13/220,822 filed on Aug. 30, 2011, which are incorporated herein by reference in their entirety.

It will be understood that the magnesium alloy or CEM, may thus have any corrosion rate necessary to achieve the desired performance of the article. In a specific embodiment, the magnesium alloy or CEM used to form the fixed member 24 has a corrosion rate of about 0.1 to about 150 $mg/cm^2$/hour, specifically about 1 to about 15 $mg/cm^2$/hour using aqueous 3 wt % KCl at 200° F. (93° C.).

The second material 20 is, in an embodiment, any material that is galvanically less active (having a lower reactivity than the first material 18 and intermediate material 26), based on, for example, the saltwater galvanic series. The second material 20 may include a lower reactivity metal such as various grades of steels, tungsten, chromium, nickel, copper, cobalt, iron, or an alloy thereof, or a combination comprising at least one of the foregoing. In one embodiment, the second material 20 may be substantially non-corrodible or inert in the downhole environment. In another embodiment, the second material 20 may be resistant to corrosion by a corrosive material. As used herein, "resistant" means the second material is not etched or corroded by any corrosive downhole conditions encountered (i.e., brine, hydrogen sulfide, etc., at pressures greater than atmospheric pressure, and at temperatures in excess of 50° C.), or any wellbore 70 fluid used in conjunction with the articles or methods described herein.

By selecting the reactivity of the first and second materials to have a greater or lesser difference in their corrosion potentials, the higher reactivity material (e.g., high reactivity metal) corrodes at a faster or slower rate, respectively. Generally, for metals in the galvanic series, the order of metals, from more noble (i.e., less active and more cathodic) to less noble (i.e., more active and more anodic) includes for example steel, tungsten, chromium, nickel, cobalt, copper, iron, aluminum, zinc, and magnesium.

When the dissimilar metal combinations described herein are brought into electrical contact in the presence of an electrolyte, an electrochemical potential is generated between the anodic, more galvanically active material and the cathodic, less galvanically active material. The greater the difference in corrosion potential between the dissimilar metals, the greater the electrical potential generated. In such an arrangement, the cathodic material is protected from corrosion by the anodic material, where the anodic material corrodes as a sacrificial anode. Corrosion of the fixed member 24, for example, in brines and other electrolytes can be controlled (eliminated or substantially reduced) when it is in the first position where it is in electrical contact with the more active first section 14. Electrically coupling the anodic material and the cathodic material with an electrolyte also produces an electrical potential that may also be used to power a downhole device, such as, for example, a device for downhole signaling or sensing.

Referring to FIG. 3, the selectively corrodible article 10 may be used as disclosed herein, and more particularly may be used in accordance with a method 100 of removing a selectively corrodible downhole article 10. The method 100 includes disposing 110 downhole a selectively corrodible downhole article 10, as described herein. The method 100 also includes exposing 120 the selectively corrodible downhole article to a first wellbore fluid 72 while the movable cylindrical member is in the first position, wherein the first section is selectively dissolved. The method 100 further includes moving 130 the movable cylindrical member to the second position. The method 100 then includes exposing 140 the selectively corrodible metallic downhole article to a second wellbore 74 fluid, wherein the fixed member is selectively dissolved.

Disposing 110 the selectively corrodible downhole article 10 downhole may be accomplished in any suitable manner, including delivery downhole by use of a wireline, slickline, tubular string or the like. The movable cylindrical member 12 and fixed member 24 may be disposed downhole as individual components, or together as part of an assembly. Whether as part of the installation or afterwards, the movable cylindrical member 12 is placed in the first position 28 where the first section 14 is disposed on and in electrical contact with the fixed member 24.

Once the first section 14 is disposed on and in electrical contact with the fixed member 24, the method 100 also includes exposing 120 the selectively corrodible downhole article to a first wellbore fluid 72 while the movable cylindrical member is in the first position, wherein the first section is selectively dissolved. The first wellbore fluid 72 may include an aqueous or non-aqueous electrolyte, depending on the application and controllability of ambient conditions. In the downhole environment, controlling the ambient conditions to exclude moisture is not practical, and hence, under such conditions, the electrolyte is generally an aqueous electrolyte. Aqueous electrolytes may include water or a salt dissolved in water, such as a brine, or an acid, or a combination comprising at least one of the foregoing. Exposing 120 the selectively corrodible downhole article 10 to a first wellbore fluid 72 may include performing a downhole operation, such as a fracking, for example. During exposing 120, the movable cylindrical member 12 is in the first position 28 where the first section 14 is disposed on and in electrical contact with the fixed member 24. In the first position 28, the more galvanically active first material 18 of the first section 14 acts as an anode and is selectively dissolved or corroded while the less galvanically active intermediate material 26 of the fixed member 24 acts as a cathode and is selectively protected from dissolution or corrosion. The movable cylindrical member 12, particularly the first section 14, and the fixed member 24 may be designed for the wellbore operation for which they are to be used to provide sufficient material for the dissolution or corrosion that occurs during the downhole operation that is to be performed.

The method 100 further includes moving 130 the movable cylindrical member 12 to the second position 30. In the second position 30, the second section 16 is disposed on and in electrical contact with the fixed member 24. In the second position 30, the fixed member 24 is configured for selective dissolution because the intermediate material 26 is more galvanically active than the second material 20. In the second position 30, the more galvanically active intermediate material 26 of the fixed member 24 acts as an anode and is selectively dissolved or corroded while the less galvanically active second material 20 of the second section 16 acts as a cathode and is selectively protected from dissolution or corrosion. The fixed member 24 and intermediate material 26 may also be selected and designed for the wellbore operation for which they are to be used, such as to provide rapid dissolution or corrosion and removal from the wellbore 70. Removing the fixed member 24 may, for example, be used to open the wellbore for a subsequent wellbore operation, such as a completion or production operation.

The method 100 then includes exposing 140 the selectively corrodible metallic downhole article 10 to a second wellbore 74 fluid, wherein the fixed member 24 is selectively dissolved. This may also include the selective dissolution of other members, such as the ball 50 or plug 60, as described herein. The second wellbore fluid may be the same wellbore fluid as the first wellbore fluid 72. Alternately, the second wellbore fluid 74 and first wellbore fluid 72 may be different wellbore fluids.

All ranges disclosed herein are inclusive of the endpoints, and the endpoints are independently combinable with each other. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A selectively corrodible downhole article, comprising:

a movable cylindrical member comprising a first section and an axially separated second section, the first section comprising a first material having a first galvanic activity, the second section comprising a second material having a second galvanic activity, the first galvanic activity being greater than the second galvanic activity, the first section being electrically isolated from the second section; and a fixed member disposed on the cylindrical member and configured for electrical contact with the first section or the second section, the fixed member comprising an intermediate material having an intermediate galvanic activity, the intermediate galvanic activity being between the first galvanic activity and the second galvanic activity, the movable cylindrical member configured for movement from a first position where the first section is disposed on and in electrical contact with the fixed member and a second position where the second section is disposed on and in electrical contact with the fixed member, wherein in the first position, the first section is configured for selective dissolution, and wherein in the second position, the fixed member is configured for selective dissolution.

2. The article of claim 1, wherein the movable member comprises a movable tubular article.

3. The article of claim 1, wherein the movable member comprises a slidable sleeve disposed within a tubular article.

4. The article of claim 1, wherein the first material comprises magnesium.

5. The article of claim 1, wherein the second material comprises steel, tungsten, chromium, nickel, copper, cobalt, iron, or an alloy thereof, or a combination comprising at least one of the foregoing.

6. The article of claim 1, wherein the intermediate material comprises magnesium, aluminum, manganese or zinc, or an alloy thereof, or a combination comprising at least one of the foregoing.

7. The article of claim 1, wherein the first section comprises a controlled electrolytic material.

8. The article of claim 1, wherein the fixed member comprises a controlled electrolytic material.

9. The article of claim 1, wherein the fixed member comprises a ball or ball seat.

10. The article of claim 1, wherein the fixed member comprises a plug or plug seat.

11. The article of claim 1, wherein the movable member comprises a movable tubular article.

12. The article of claim 1, wherein the movable member comprises a slidable sleeve dispose on or within a tubular article.

13. The article of claim 1, wherein the first material comprises magnesium.

14. The article of claim 1, wherein the second material comprises steel, tungsten, chromium, nickel, copper, cobalt, iron, or an alloy thereof, or a combination comprising at least one of the foregoing.

15. The article of claim 1, wherein the intermediate material comprises magnesium, aluminum, manganese or zinc, or an alloy thereof, or a combination comprising at least one of the foregoing.

16. The article of claim 1, wherein the first section comprises a controlled electrolytic material.

17. The article of claim 1, wherein the fixed member comprises a controlled electrolytic material.

18. The article of claim 1, wherein the fixed member comprises a ball or ball seat.

19. The article of claim 1, wherein the fixed member comprises a plug or plug seat.

20. A method of removing a selectively corrodible downhole article, comprising:

disposing downhole a selectively corrodible downhole article, comprising: a movable cylindrical member comprising a first section and an axially separated second section, the first section comprising a first material having a first galvanic activity, the second section comprising a second material having a second galvanic activity, the first galvanic activity being greater than the second galvanic activity, the first section being electrically isolated from the second section; and a fixed member disposed on the cylindrical member and configured for electrical contact with the first section or the second section, the fixed member comprising an intermediate material having an intermediate galvanic activity, the intermediate galvanic activity being between the first galvanic activity and the second galvanic activity, the movable cylindrical member configured for movement from a first position where the first section is disposed on and in electrical contact with the fixed member and a second position where the second section is disposed on and in electrical contact with the fixed member, wherein in the first position, the first section is configured for selective dissolution, and wherein in the second position, the fixed member is configured for selective dissolution;

exposing the selectively corrodible downhole article to a first wellbore fluid while the movable cylindrical member is in the first position, wherein the first section is selectively dissolved;

moving the movable cylindrical member to the second position; and exposing the selectively corrodible metallic downhole article to a second wellbore fluid, wherein the fixed member is selectively dissolved.

21. The method of claim 20, wherein the fixed member is selectively dissolved sufficiently to remove the fixed member from the selectively corrodible downhole article.

22. The method of claim 20, wherein the first wellbore fluid and the second wellbore fluid are the same fluid.

23. The method of claim 20, wherein the first wellbore fluid and the second wellbore fluid are different fluids.

* * * * *